US010066623B2

(12) United States Patent
Stoop et al.

(10) Patent No.: US 10,066,623 B2
(45) Date of Patent: Sep. 4, 2018

(54) SCROLL COMPRESSOR

(71) Applicant: ATLAS COPCO AIRPOWER, NAAMLOZE VENNOOTSCHAP, Wilrijk (BE)

(72) Inventors: Koen Stoop, Wilrijk (BE); Benjamin Moens, Wilrijk (BE)

(73) Assignee: ATLAS CAPCO AIRPOWER, NAAMLOZE VENNOTSCHAP, Wilrijk (BE)

( * ) Notice: Subject to any disclaimer, the term of this patent is extended or adjusted under 35 U.S.C. 154(b) by 177 days.

(21) Appl. No.: 14/766,628

(22) PCT Filed: Feb. 11, 2014

(86) PCT No.: PCT/BE2014/000009

§ 371 (c)(1),
(2) Date: Aug. 7, 2015

(87) PCT Pub. No.: WO2014/124503

PCT Pub. Date: Aug. 21, 2014

(65) Prior Publication Data

US 2015/0369244 A1 Dec. 24, 2015

(30) Foreign Application Priority Data

Feb. 15, 2013 (BE) ..... 2013/0101

(51) Int. Cl.
*F04C 18/02* (2006.01)

(52) U.S. Cl.
CPC ..... *F04C 18/0269* (2013.01); *F04C 18/0215* (2013.01); *F04C 18/0246* (2013.01); *F04C 2250/20* (2013.01); *F04C 2270/17* (2013.01)

(58) Field of Classification Search
CPC ..... F04C 18/0215; F04C 18/0246; F04C 18/0269; F04C 2250/20; F04C 2270/17
(Continued)

(56) References Cited

U.S. PATENT DOCUMENTS 5,370,512 A * 12/1994 Fujitani ..... F04C 29/0035 418/55.2
5,765,999 A * 6/1998 Ito ..... F04C 18/0269 418/55.2
(Continued)

FOREIGN PATENT DOCUMENTS

JP H08-004669 A 1/1996
JP H08-86287 A 4/1996
(Continued)

OTHER PUBLICATIONS

Japanese Office Action dated Nov. 7, 2016, for JP 2015-557295, and English translation thereof.
(Continued)

*Primary Examiner* — Mark Laurenzi
*Assistant Examiner* — Anthony Ayala Delgado
(74) *Attorney, Agent, or Firm* — Bacon & Thomas, PLLC

(57) ABSTRACT

Scroll compressor with a stationary, stator scroll and a movable rotor scroll and a drive to move the rotor, whereby in each position places are formed with an instantaneous minimum opening between the rotor scroll and the stator scroll whereby at each height in a minimum opening there is a local transverse internal clearance (S), whereby at least one of the stator flanks or rotor flanks comprises an adapted flank section with an initial local stator flank deviation ($\Delta T_0 i$, $AT_0 u$) or rotor flank deviation ($\Delta R_0 i/AR_0 u$) that is different to zero at each point when the rotor is stationary, and during nominal operation of the scroll compressor corresponding instantaneous final local stator flank deviations ($\Delta T_f i$, $\Delta T_f u$) or rotor flank deviations ($\Delta R_f i$, $\Delta R_f U$) whose absolute values are smaller.

20 Claims, 18 Drawing Sheets

(58) Field of Classification Search
USPC ..... 418/55.2
See application file for complete search history.

(56) References Cited

U.S. PATENT DOCUMENTS

| | | | | |
|---|---|---|---|---|
| 5,944,500 | A * | 8/1999 | Iizuka | F04C 18/0246 418/55.2 |
| 6,695,598 | B2 * | 2/2004 | Fujita | F04C 18/0276 418/55.2 |

FOREIGN PATENT DOCUMENTS

| | | | |
|---|---|---|---|
| JP | H10-89268 | A | 4/1998 |
| JP | H11-159481 | A | 6/1999 |
| JP | 2004-245059 | A | 9/2004 |
| JP | 2012-188990 | A | 10/2012 |

OTHER PUBLICATIONS

International Search Report (ISR) dated Dec. 4, 2014, for PCT/BE2014/000009.

* cited by examiner

SCROLL COMPRESSOR

The present invention relates to a scroll compressor.

BACKGROUND OF THE INVENTION

As is known a scroll compressor generally comprises the following elements:

- a housing;
- a stator that is immovably affixed in the housing and which comprises a stationary stator scroll with a central stator axis, whereby this stator scroll is formed by a stator strip with two stator flanks that is wound spirally along its length and which is affixed upright with a certain height on a stator plate;
- a rotor that is movably affixed in the housing and which comprises a rotor scroll with a central rotor axis, and this rotor scroll is formed by a rotor strip with two rotor flanks that is wound spirally along its length, and which is affixed upright with a certain height on a rotor plate and whereby the rotor scroll and the stator scroll are affixed in one another between the stator plate and the rotor plate;
- a low pressure inlet on the outside of the scroll compressor; and
- a high pressure outlet in the centre of the scroll compressor; and,
- a drive for a movement of the rotor whereby the central rotor axis circles eccentrically around the central stator axis without the rotor hereby undergoing a rotation around the central rotor axis.

It is also known that in each position of the rotor in the stator during this circling and eccentric movement of the rotor with respect to the stator, places are formed where there is a maximum or minimum opening between the rotor scroll and stator scroll.

It is the case here that these places with a minimum and maximum opening at each position of the rotor with respect to the stator, are located in a plane that comprises both central axes, which will be further clarified in the text on the basis of drawings, whereby this plane will be called the sealing plane hereinafter.

Attention is hereby drawn to the fact that the minimum openings at every moment during the movement of the rotor in fact define compression chambers, but they are not hermetically sealed on account of internal clearances in the scroll compressor, as could be incorrectly thought from the name sealing plane.

The compression chambers continually change shape during the circling eccentric movement of the rotor, whereby air or gas supplied to the outside of the scroll compressor via the inlet is continually pushed more deeply towards the centre of the scroll compressor, where the compression chambers occupy a smaller volume, so that the air or gas is increasingly compressed until the compressed air or gas can finally leave the scroll compressor via the outlet in the centre of the scroll compressor.

It should also be noted that the rotor scroll and the stator scroll, in the places with a minimum opening at each height along the rotor flanks and stator flanks, are located at a certain radial distance from one another whereby these distances can thus be considered as local transverse internal clearances of the scroll compressor.

A transverse internal clearance here means that it is a clearance in the scroll compressor in a direction transverse to the rotor flanks and the stator flanks.

Of course there are also internal clearances between the rotor tip and the stator plate and between the stator tip and the rotor plate, whereby these clearances are further designated in the text as lateral internal clearances.

For a good operation of the scroll compressor all the internal clearances, and in particular the local transverse internal clearances, must remain above a certain minimum value at all times in order to prevent contact between the rotor scroll and the stator scroll.

On the other hand, large internal clearances and in particular large local transverse internal clearances are also undesirable, as this would lead to a large leakage rate and pressure loss in the scroll compressor, with recompression of air or gas and would thus result in extra heat generation such that the efficiency of the scroll compressor is considerably negatively influenced.

In other words it comes down to realising the smallest possible internal clearance in the scroll compressor without running the risk of the rotor scroll coming into contact with the stator scroll during its movement.

A great difficulty here is that the internal clearances in the scroll compressor are far from a static fact.

Indeed, in the transition from an initial stationary state of the rotor, when the scroll compressor is not in use, to a final state during nominal service of the scroll compressor, whereby the rotor is moving at full speed, the pressures of course change significantly, as it is the intention to compress air or gas, as do the temperatures in the scroll compressor.

These changes of pressures and temperatures in the scroll compressor are accompanied by a deformation of the stator scroll and the rotor scroll, whereby the local internal clearances in the scroll compressor change as a result of such deformations.

In order to describe a number of these dynamic phenomena more easily, a number of items will first be defined hereinafter.

From the foregoing it can be concluded that the intersecting lines of the flanks of the stator scroll and the rotor scroll with the stator plate or rotor plate concerned form spiral base edges.

Hereby the geometric location of the points through which a perpendicular line on the stator plate or rotor plate intersects in an aforementioned spiral base edge determines spiral flanks, that will be called the ideal spiral flanks hereinafter.

In brief, the ideal spiral flanks are flanks that are perpendicular to the rotor plate and stator plate, so that there is a constant internal clearance viewed over the height of the flanks in the given situation, at least insofar the rotor plate and stator plate are parallel to one another, which is of course the intention.

Furthermore, in the text the terms "local rotor flank deviation" and "local stator flank deviation" are used as referring to the radial distance from a point on an ideal spiral flank of the rotor scroll or stator scroll to the closest point on the corresponding spiral flank of the rotor scroll or stator scroll respectively, whereby a local rotor flank deviation or a local stator flank deviation has a positive sign when the deviation is directed in a direction away from the central axis concerned, or thus when the distance between the point concerned and the central axis concerned is greater than the distance between the corresponding point on the ideal spiral flank and the central axis concerned.

In the reverse case whereby the deviation is directed towards the central axis, the rotor flank deviation or stator flank deviation concerned will have a negative sign.

Moreover, in general it can be said that a local transverse internal clearance in a minimum opening is composed of an interjacent basic clearance defined by the radial distance in the sealing plane between the ideal spiral flanks located closest to the flanks concerned and of a local clearance deviation.

In brief every local transverse internal clearance can be described as the sum of a desired 'ideal' basic clearance and a local clearance deviation that is due to local deviations of the rotor scroll and the stator scroll in the sealing plane concerned with respect to the ideal spiral flanks.

Hereby the local clearance deviation is the difference between a local rotor flank deviation and a local stator flank deviation.

More specifically, the local rotor flank deviation and the local stator flank deviation respectively, which form the local clearance deviation concerned, are the deviations of the rotor scroll and the stator scroll with respect to the ideal spiral flank at the location of the points of the rotor flank concerned and the stator flank concerned that are located at the height concerned of the local transverse internal clearance concerned, and which moreover are located in the sealing plane concerned.

When going from a stationary state of the rotor to a state in nominal service after starting the scroll compressor, the pressures and temperatures in the scroll compressor change resulting in a deformation of the stator scroll and the rotor scroll and a change of the local stator flank deviations and local rotor flank deviations, thus of the local transverse internal clearances.

In order to facilitate the use of words in this text, a state of the scroll compressor and its elements when stationary is designated by the adjective 'initial', while a state of the scroll compressor and its elements during nominal operation is further designated by the adjective 'final'.

Of course there is nothing 'initial' or 'final' about the states concerned, whereby more specifically attention must be drawn to the fact that in the 'final' state in nominal service the rotor is moving at full speed and the various elements of the scroll compressor in this final state thus take on a multitude of instantaneous forms and instantaneous positions.

Furthermore, it can be said that that the local transverse internal clearances for each position of the rotor when the scroll compressor is stationary at ambient temperature and ambient pressure present a clearance profile over the height, hereinafter termed the initial or stationary clearance profile, while these local transverse clearances for each position of the rotor during nominal service of the scroll compressor at operating temperature and operating pressure present a different instantaneous clearance profile over the height, hereinafter termed an instantaneous final clearance profile or an instantaneous circulating clearance profile.

Generally it is the case that in the known scroll compressors the stator scroll and the rotor scroll are constructed with a constant thickness, whereby the two flanks of each scroll are perpendicular to the rotor plate or stator plate concerned, at least when the scroll compressor is stationary and at normal ambient temperatures and ambient pressures, so that the flanks of the stator scroll and the rotor scroll coincide with the ideal spiral flanks when stationary.

In brief, with such known scroll compressors the initial local rotor flank deviations and initial local state flank deviations when the known scroll compressor is stationary are as good as zero, so that in the minimum openings during stoppage there are also no initial local clearance deviations, irrespective of the position of the rotor and irrespective of which sealing plane it concerns.

Hereby the flanks of the stator scroll and the rotor scroll of the known scroll compressor when stationary are parallel or as good as parallel to one another, whereby the stationary clearance profile of the local transverse internal clearances in a sealing plane presents little or no variation, or in other words, whereby at each height in the sealing plane concerned the initial local transverse internal clearance is just as large and equal to the aforementioned basic clearance.

In a final state of the scroll compressor in nominal service, the stator scroll and the rotor scroll take on different instantaneous final forms, compared to the initial form when stationary, whereby the instantaneous local transverse clearances in a sealing plane are composed of a final aforementioned basic clearance and an instantaneous final (or circulating) local clearance deviation, that is a function of the local instantaneous form of the rotor scroll and the stator scroll during nominal service of the scroll compressor.

Hereby during nominal operation of the scroll compressor the pressures and temperatures in its centre, where the outlet of the scroll compressor is also located, are the highest, while the pressures and temperatures in the scroll compressor decrease in the more radially outward parts of the scroll compressor.

Moreover, it is the case that cooling fins are generally provided on the side of the rotor plate and the stator plate, opposite the rotor scroll and stator scroll respectively.

A consequence of this is that the base of the rotor scroll and the base of the stator scroll are better cooled than the tip of the rotor scroll and the tip of the stator scroll, such that during nominal service of the scroll compressor a temperature gradient consequently prevails over the height of the rotor scroll and over the height of the stator scroll, with an increasing temperature towards their tips.

All these pressure and temperature effects, more specifically pressures and temperatures that decrease from the centre to the outside, and temperatures that increase from the base to the tip of the scroll concerned, mean that the rotor scroll and the stator scroll tend to deform, such that the rotor tip and the stator tip bend away from the centre towards the outside of the scroll compressor.

Depending on the position in the scroll compressor, in a minimum opening, a rotor tip for example can thus tend towards the opposite stator base, while on the contrary the opposite stator tip at this position tends away from the rotor base at this position.

Analogously, depending on the position in the scroll compressor, a stator tip can tend towards the opposite rotor base, while on the contrary the opposite rotor tip at this position tends away from the stator base at this position.

A consequence of this is that the local transverse internal clearance at certain heights in an instantaneous sealing plane during nominal operation of the scroll compressor can be greatly decreased, compared to the local transverse internal clearance at this height in the same sealing plane when the scroll compressor is stationary.

On the other hand it is also possible that at other heights in the same instantaneous sealing plane concerned, this local transverse internal clearance during operation of the scroll compressor has increased compared to the local transverse internal clearance at this height in the same instantaneous sealing plane when the scroll compressor is stationary.

This means that under the effects of the pressures and temperatures, the local instantaneous transverse internal clearance during nominal operation of the scroll compressor can easily become all too small at certain positions of the rotor in the stator when nothing is done.

With known scroll compressors this problem is solved by making the initial clearances, when the known scroll compressor is stationary, sufficiently large.

In addition it is the case that at places where the local transverse internal clearance increases during operation of the scroll compressor, the internal leakage rate and the internal pressure loss between compressor chambers of the scroll compressor increase.

With known scroll compressors, this phenomenon is further reinforced by the aforementioned measure whereby the clearances in the scroll compressor when stationary are made large to ensure a minimum local transverse internal clearance at all heights of the stator scroll and rotor scroll during nominal operation of the scroll compressor.

In brief, the internal clearances in a scroll compressor during nominal operation greatly affect the efficiency of the scroll compressor, and with the known scroll compressors it can be difficult to stay within the bounds and/or the circulating clearance profile of the local transverse internal clearances in the scroll compressor is highly variable or can be difficult to evaluate beforehand.

This problem is all the more acute as the pressures and temperatures in the scroll compressor rise, the powers increase or the speed of motion of the rotor in the stator increases.

SUMMARY OF THE INVENTION

The purpose of the present invention is to provide a solution to one or more of the aforementioned and any other disadvantages.

More specifically, first and foremost the purpose of the invention is realise specific internal clearances in a scroll compressor during full operation, preferably with the most constant possible profile over the height of the stator flanks and the rotor flanks, whereby also preferably the smallest possible circulating clearance deviation is realised with respect to a given basic clearance during nominal service of the scroll compressor.

To this end the invention concerns a scroll compressor of a type as described above, whereby this scroll compressor is characterised in that at least one of the stator flanks or rotor flanks comprises an adapted flank section whose form is initially adapted by there being a local initial rotor flank deviation or a local initial stator deviation that is different to zero at each point of the adapted flank section concerned in an initial stationary state of the scroll compressor, whereby upon a transition of the scroll compressor from the initial stationary state to a final state in nominal service, the stator scroll and the rotor scroll deform such that during the movement of the rotor in nominal service there is an instantaneous final local stator flank deviation, or an instantaneous final local rotor flank deviation at each point of the aforementioned adapted flank section concerned and in each position of the rotor, whose absolute value is less than the corresponding local initial stator flank deviation or the local initial rotor flank deviation at the same point when the rotor is stationary.

A great advantage of such a scroll compressor according to the invention is that during the design, account is already taken of the deformations that the stator scroll and the rotor scroll undergo under the effect of the pressures and temperatures that occur when going from an initial stationary state of the scroll compressor to a final state in nominal service.

This ensures that the rotor scroll or the stator scroll or both are provided with one or more adapted flank sections that have such an initial form when the scroll compressor is stationary that differs from the defined 'ideal' flank section placed perpendicularly on the stator plate or rotor plate, and this in such a way that as a result of a transition of the scroll compressor to a final state in nominal service, the aforementioned flank section undergoes a deformation and this such that the instantaneous final form of the flank section fits more closely to an ideal flank section that is perpendicular to the stator plate or rotor plate.

It will be understood that such deformations of an aforementioned adapted flank section have a positive effect on the instantaneous final local internal clearances at the points concerned of the flank section during nominal operation of the scroll compressor.

The aforementioned formulation of the phenomenon that occurs during a transition from a stationary state to nominal service of the scroll compressor, could create the impression that at nominal service the pressures and temperatures in the scroll compressor are a static aspect, which is not the case.

The pressure and temperature present at a point of a flank of the stator scroll or the rotor scroll continually changes during the movement of the rotor, such that in reality during the movement of the rotor the deformation of the stator scroll and the rotor scroll during this movement is different at each moment.

According to a more precise formulation, account can also be taken of this dynamism and it can be said that when the scroll compressor is stationary, the aforementioned local initial rotor flank deviation or the local initial stator flank deviation of the adapted flank sections makes an initial local contribution to corresponding local initial or stationary clearance deviations in the sealing planes concerned.

During operation of the scroll compressor in nominal service the stator scroll and rotor scroll deform, such that during the movement of the rotor there are instantaneous final local stator flank deviations or instantaneous final local rotor flank deviations at each point of the aforementioned adapted flank section concerned.

These are such that they make an instantaneous final local contribution to corresponding instantaneous local final or circulating clearance deviations in the instantaneous sealing planes concerned, whereby the absolute value of these instantaneous final local contributions during operation are smaller than the local initial contribution to the corresponding local initial clearance deviations in the corresponding sealing planes that relate to the same point, and this at least for some of the positions occupied by the rotor during a complete rotation of the central axis BB'.

As the pressure changes and temperature changes at each point of the stator scroll and rotor scroll during the rotation of the rotor are rather small compared to the pressure changes and temperature changes at each point between the stationary state and nominal service, in practice both formulation methods are approximately equivalent.

It should be noted that a scroll compressor according to the invention is an improvement with respect to the known scroll compressors because it is at least ensured that with an adapted flank section of the stator scroll or rotor scroll, the absolute value of the instantaneous final local contribution to instantaneous local circulating clearance deviations as a result of the deformation thereof, after starting up the scroll compressor, is less than the initial contribution to corresponding initial clearance deviations when the scroll compressor is stationary, and this for at least some of the positions of the rotor in the stator.

This does not in any way mean that a scroll compressor according to the invention necessarily has to have local final clearances during operation in nominal service, without any clearance deviation or with local clearance deviations, which in their entirety decrease between the stationary state and nominal service or similar.

In brief, the design of a scroll compressor according to the invention is focused on improving the final internal local clearances in the scroll compressor during operation in nominal service, i.e. making them more even and more predictable, than is currently the case with the known scroll compressors.

Such a design is indeed in stark contrast to the designs of the known scroll compressors, whereby, as set out above, the initial local stator flank deviations and rotor flank deviations are small or zero, and thus the initial contribution of them to initial local clearance deviations is rather small or zero, but whereby the instantaneous local deformations as a result of the transition of the scroll compressor to nominal service are of such a nature that the instantaneous final local stator flank deviations and rotor flank deviations make an instantaneous final contribution to final clearance deviations during nominal operation of the scroll compressor, which in absolute value is much larger than the aforementioned initial contribution to corresponding initial clearance deviations.

A consequence of this is that with the known scroll compressors, the final local transverse internal clearances present a strongly varying circulating clearance profile with large final clearance deviations, whereby in some places in the minimum openings smaller internal clearances and in others larger internal clearances occur than desired.

In known scroll compressors the rotor scroll and stator scroll are generally constructed with a constant thickness and the transverse profile of the stator scroll and the rotor scroll consequently have a rectangular form, with any groove at the level of its tip not taken into account.

Moreover, the flanks of the stator scroll and the rotor scroll in known scroll compressors when stationary are oriented perpendicularly with respect to the stator plate and the rotor plate respectively, so that the stator flanks and rotor flanks are parallel to one another when the scroll compressor is stationary in every position of the rotor with respect to the stator, and thus the local transverse internal clearances in the known scroll compressors have an initial or stationary clearance profile over the height that presents no or practically no initial variation.

As a result of the deformations of the stator scroll and the rotor scroll during a transition to nominal service, the aforementioned flanks in the known scroll compressors are thus in a non-parallel final position, often bent away from one another, generally also in each position of the rotor in the stator, whereby the local transverse internal clearances in these known scroll compressors have a final clearance profile over the height during nominal service that presents a rather strong final variation, whereby this final variation is greatly increased with respect to the aforementioned initial variation, and this in all positions of the rotor.

A large aforementioned final variation in the final profile of the local transverse internal clearances in the scroll compressor is highly negative, as this means that there is a large difference between the minimum local transverse internal clearance in a minimum opening and the maximum local transverse internal clearance in the same minimum opening in the position concerned of the rotor in the stator.

In brief, somewhere over the height the minimum local internal clearance is all too small, while taken generally over the entire height of the stator scroll or rotor scroll, the internal clearances are nevertheless large resulting in a rather large minimum opening or in other words a large leakage rate or large pressure loss.

In contrast to what is the case with the known scroll compressors, it is thus the intention that with a scroll compressor according to the invention, the variation of the profile of the local transverse internal clearances over the height of the stator scroll and the rotor scroll decreases as much as possible, when corresponding positions of the rotor in the stator are compared when stationary or in nominal service.

The solution provided by the invention to achieve the desired result consists of adapting the initial form of the adapted flank section when the scroll compressor is stationary by making local stator flank deviations and rotor flank deviations that are different to zero, taking account of the deformations that will take place during a transition of the scroll compressor from the stationary state to nominal service.

According to the invention this can be done for example by adapting the transverse profile of the rotor scroll or the transverse profile of the stator scroll or of both scrolls when the scroll compressor is stationary.

Typically, in a scroll compressor according to the invention, an aforementioned adaptation of the transverse profile of the rotor scroll, the stator scroll or both scrolls will mean that this transverse profile at the location of an adjusted flank section deviates from the typical rectangular profile known in the known scroll compressors.

A typical adaptation can consist of placing a flank section of one of the stator flanks or both stator flanks or one of the rotor flanks or both rotor flanks at least partially in an initial non-perpendicular position with respect to the rotor plate concerned or stator plate concerned respectively, at least in a state whereby the scroll compressor is not in use.

It is of course the intention here that due to the start-up of the scroll compressor and the pressures and temperatures hereby occurring, a deformation of this transverse profile is obtained, such that after the deformation, instantaneous final local stator flank deviations or rotor flank deviations are obtained that make the smallest possible contribution to the instantaneous final local clearance deviations, and thus the final instantaneous local internal clearances are as equal as possible to the aforementioned instantaneous basic clearance, such that a more predictable final clearance in the scroll compressor can be obtained than with the known scroll compressors.

An additional objective of the invention is to decrease the variation of the final profile of the local transverse internal clearances over the height of the stator scroll and the rotor scroll as much as possible, and ideally to reduce it to zero, and this of course for as many possible positions of the rotor in the stator.

Indeed, when the variation of the aforementioned final profile of the local transverse internal clearances reduces, then there is a smaller difference between the minimum local transverse internal clearance in a minimum opening and the maximum local transverse internal clearance in this minimum opening, such that taken generally over the entire height, the stator scroll and the rotor scroll can be brought closer together in full service at the location of the minimum openings than is the case with the known scroll compressors, which of course is very favourable for the efficiency of the scroll compressor according to the invention, as a more limited internal leakage flow can be realised as well as a more limited internal compression loss.

An additional advantage of this is that due to the reduced leakage rate, less recompression of the air occurs, such that taken generally the operating temperatures in the scroll compressor are kept lower.

In practice a decrease of the variation of the final clearance profile of the local internal transverse clearances over the height can be easily obtained, for example because an adapted flank section of one of the aforementioned flanks or both of the rotor scroll or stator scroll concerned, which were initially in a non-perpendicular position with respect to the stator plate or rotor plate, will tend towards a rather perpendicular position in full service due to deformation.

Of course, there are many other possibilities according to the invention, of which only a few are discussed hereinafter, which essentially come down to a deformation being anticipated by giving parts of the scroll compressor an initial adapted shape.

BRIEF DESCRIPTION OF THE DRAWINGS

With the intention of better showing the characteristics of the invention, a few preferred embodiments of a scroll compressor according to the invention are described hereinafter by way of an example, without any limiting nature, with reference to the accompanying drawings, wherein:

FIG. 3 shows a cross-section through the scroll compressor of FIGS. 1 and 2 in an assembled state;

DETAILED DESCRIPTION OF THE INVENTION

Figure 1:
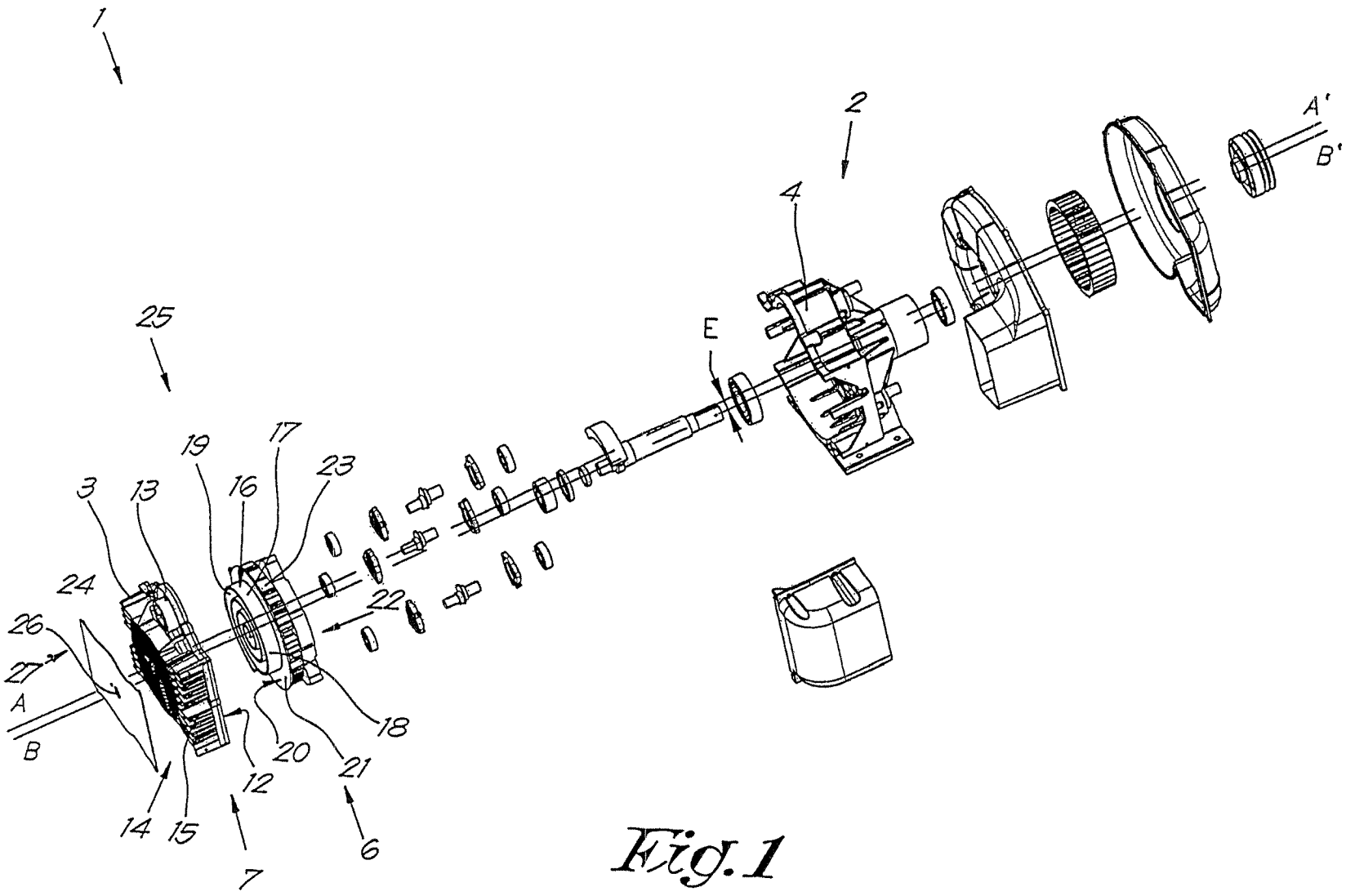
FIGS. 1 and 2 shows an exploded view in perspective of a scroll compressor, respectively from two opposite points of view.
Figure 2:
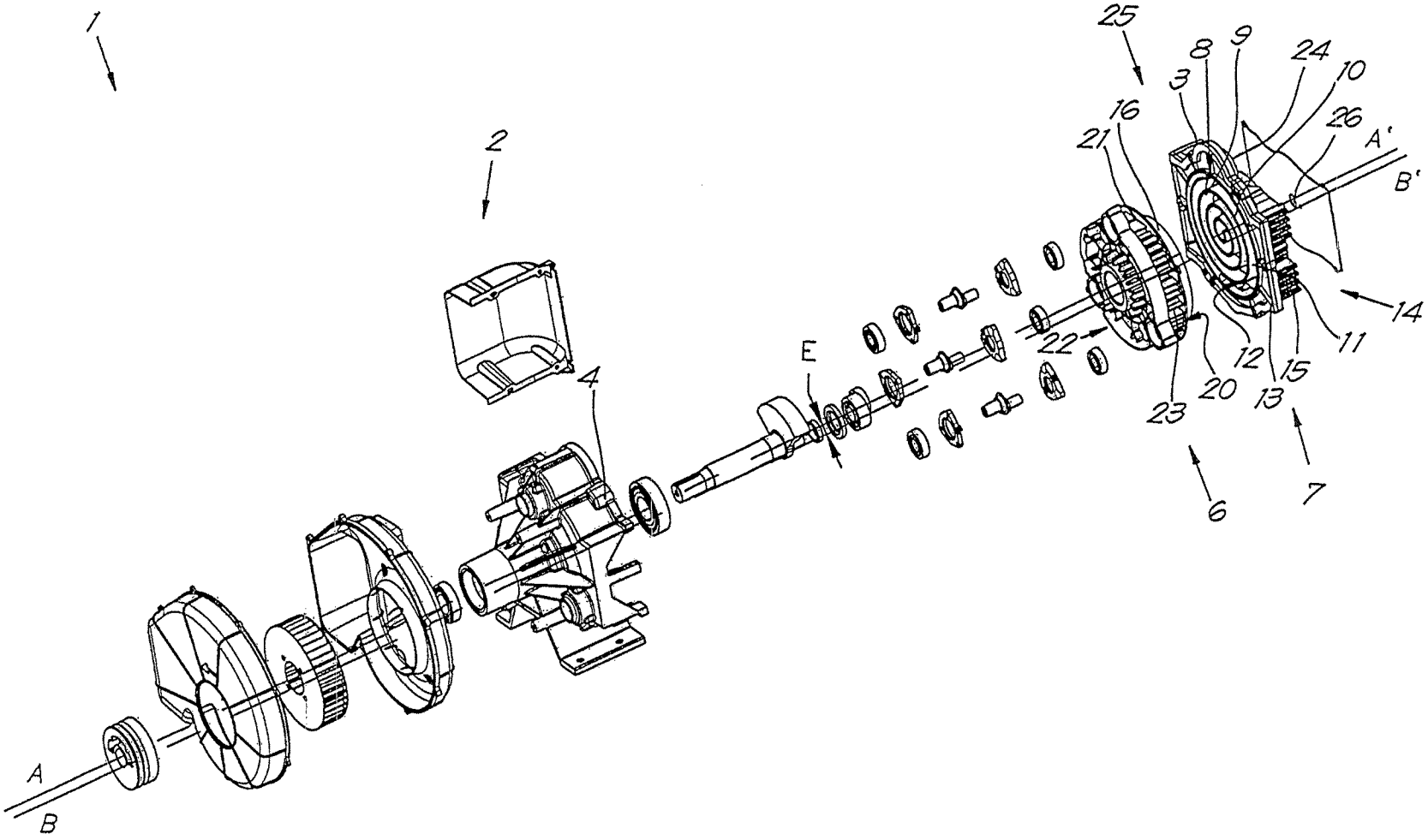

The elements shown in FIGS. 1 to 3 present an oil-free scroll compressor 1 in an expanded and assembled state and of a type to which the invention relates.

This scroll compressor 1 has a housing 2, which in this case is essentially composed of two sections, more specifically section 3 and section 4, which in the assembled state enclose a space 5 in which a rotor 6 is affixed.

Moreover, the section 3 forms a stator 7 that is affixed immovably in the housing 2 and which comprises a stationary stator scroll with a central stator axis AA'.

This stator scroll 8 is formed by a stator strip 9 with two stator flanks 10 and 11, respectively an outward stator flank 10 that is turned away from the centre or the central axis AA' of the stator scroll 8, and an inward stator flank 11 that is turned towards the centre or towards the central axis AA' of the stator scroll 8.

Moreover, the stator strip 9 is wound spirally along its length and affixed upright with a certain height H on a first side 12 of a stator plate 13.

Cooling fins 15 are provided on the other side 14 of the stator plate 13.

The rotor 6 can be moved in the housing 2 and has a rotor scroll 16 with a central rotor axis BB', which extends parallel to the central axis AA' of the stator 7, at a certain distance E from it.

The rotor scroll 16 is formed by a rotor strip 17 with two rotor flanks 18 and 19, respectively an outward rotor flank 18 that is turned away from the centre or from the central axis BB' of the rotor scroll 16, and an inward rotor flank 19 that is turned towards the centre or towards the central axis AA' of the rotor scroll 16.

Moreover, the rotor strip 17 is wound spirally along its length and affixed upright with a certain height H' to a first side 20 of a rotor plate 21.

Cooling fins 23 are also provided on the other side 22 of the rotor plate 21, just as with the stator 7.

In the assembled state of the scroll compressor 1 the rotor scroll 16 and the stator scroll 8 are affixed in one another between the stator plate 13 and the rotor plate 21 in order to be able to work together to compress air or possibly another gas.

The scroll compressor 1 is further provided with a low pressure inlet 24 on the outside 25 of the scroll compressor 1 to draw in ambient air or gas, as well as with a high pressure outlet 26 at the centre 27 of the scroll compressor 1 to remove compressed air or gas.

In order to be able to drive the rotor 6 the scroll compressor 1 is further provided with a drive that is such that the rotor 6 can make a movement, whereby the central rotor axis BB' circles eccentrically around the central stator axis AA', more specifically over a circle C with a radius R, which aside from a clearance, is practically equal to the distance E between the central rotor axis BB' and the central stator axis AA', which is shown more clearly in FIGS. 4 to 11.

As is known, during its motion the rotor 6 does not undergo a rotation around the central rotor axis BB'.

The movement of the rotor 6 in the stator 7 is illustrated in FIGS. 4 to 7, whereby in each subsequent drawing the central axis BB' is moved a quarter stroke further over the circle C.

This clearly shows that in each position of the rotor 6 in the stator 7 during this circling and eccentric movement of the rotor 6, places 28 are formed where there is a maximum opening 28 and places 29 where there is a minimum opening 29 between the rotor scroll 16 and the stator scroll 18.

It is also clear that those places with a minimum opening and maximum opening 28 lie in the plane MM' at all times, which comprises the parallel central axes AA' and BB' of the stator scroll 8 and the rotor scroll 16 respectively.

As set out in the introduction, this plane MM' is designated in this text by the name sealing plane MM'.

Figure 4:
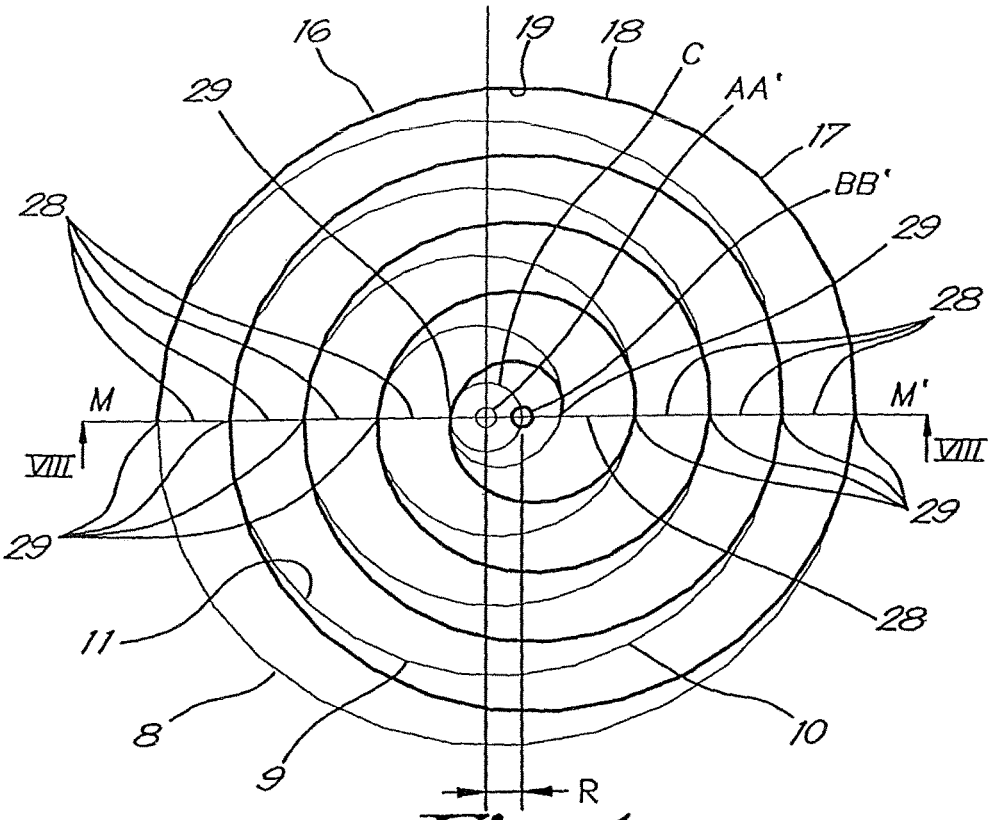
Figure 5:
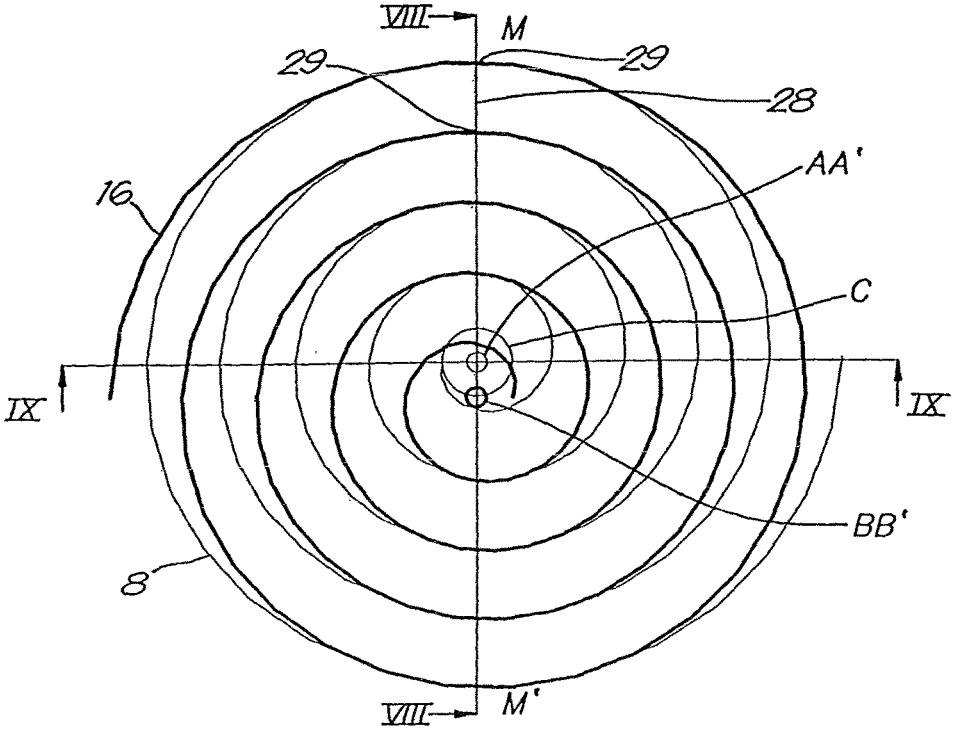
Figure 6:
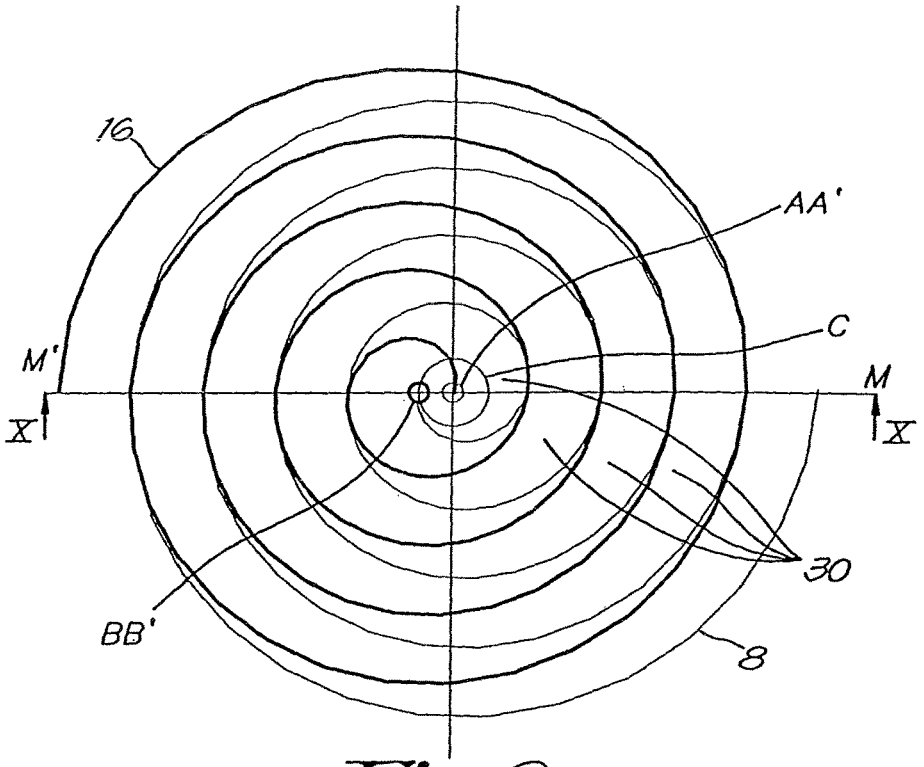
Figure 8:
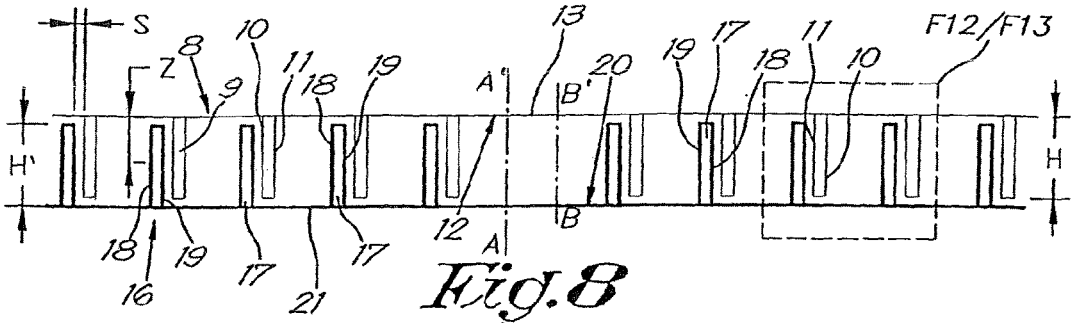
Fig.8 (Prior Art)
FIGS. 8 to 11 schematically show cross-sections through a known scroll compressor, with some exaggeration of the internal clearances, according to the lines VIII-VIII to XI-XI designated in FIGS. 4 to 7.
Figure 9:
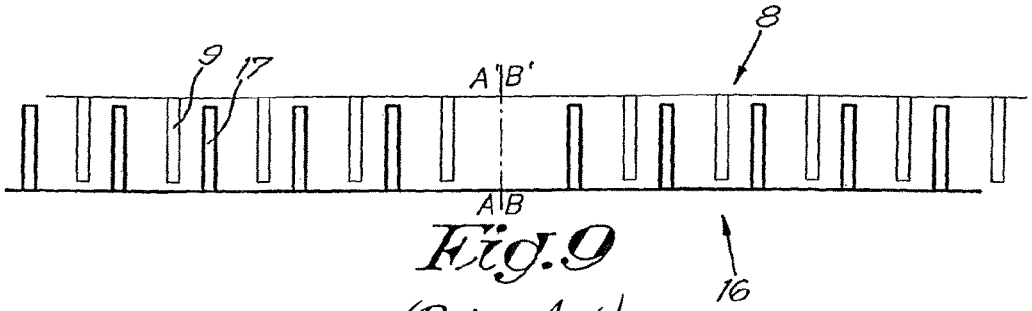
Fig.9 (Prior Art)
Figure 10:
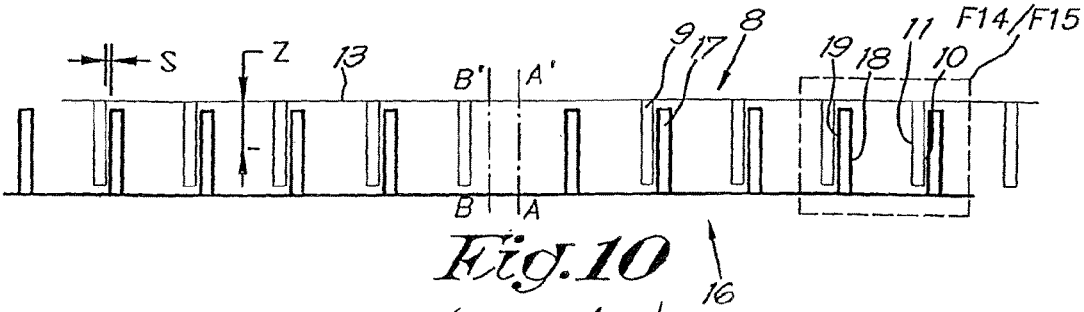
Fig.10 (Prior Art)
Figure 11:
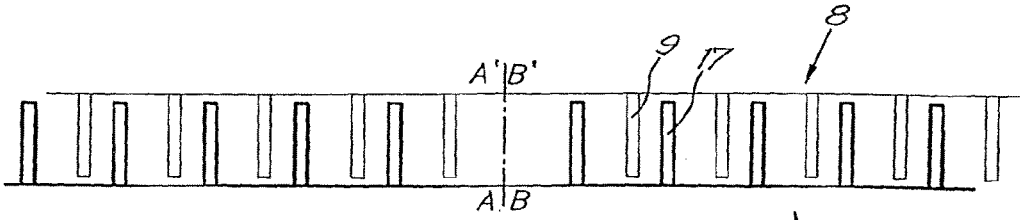
Fig.11 (Prior Art)

It can be seen from FIGS. 4 and 6 and the accompanying cross-sections shown in FIGS. 8 and 10 that in a complete circular movement of the central rotor axis BB' around the central stator axis AA', there are two positions each time whereby the places with a minimum opening 29 and maximum opening 28 are in the same sealing plane MM'.

These two positions of the central rotor axis BB' are more specifically a first position whereby the central rotor axis BB' is in a first position with respect to the central stator axis AA', and a second position whereby the central rotor axis BB' is in a second position with respect to the central stator axis AA' that is diametrically opposite its first position.

Figure 5:
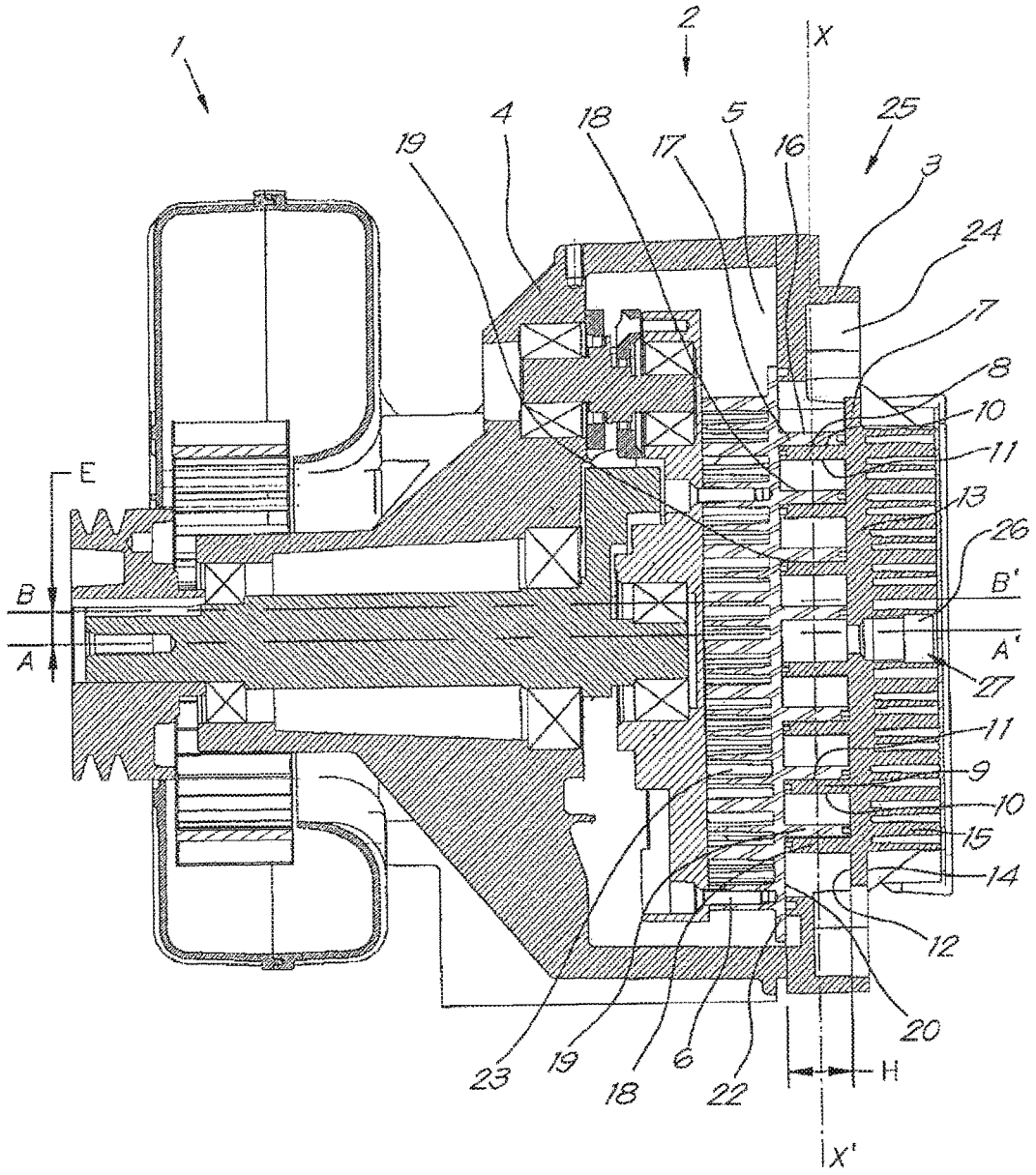
FIGS. 4 to 7 schematically show a cross-section through an assembled scroll compressor, to illustrate the operation of a scroll compressor, parallel to the line XX' in FIG. 3 corresponding to the stator plate, whereby the rotor scroll is in successive positions with respect to the stator scroll.
Figure 7:
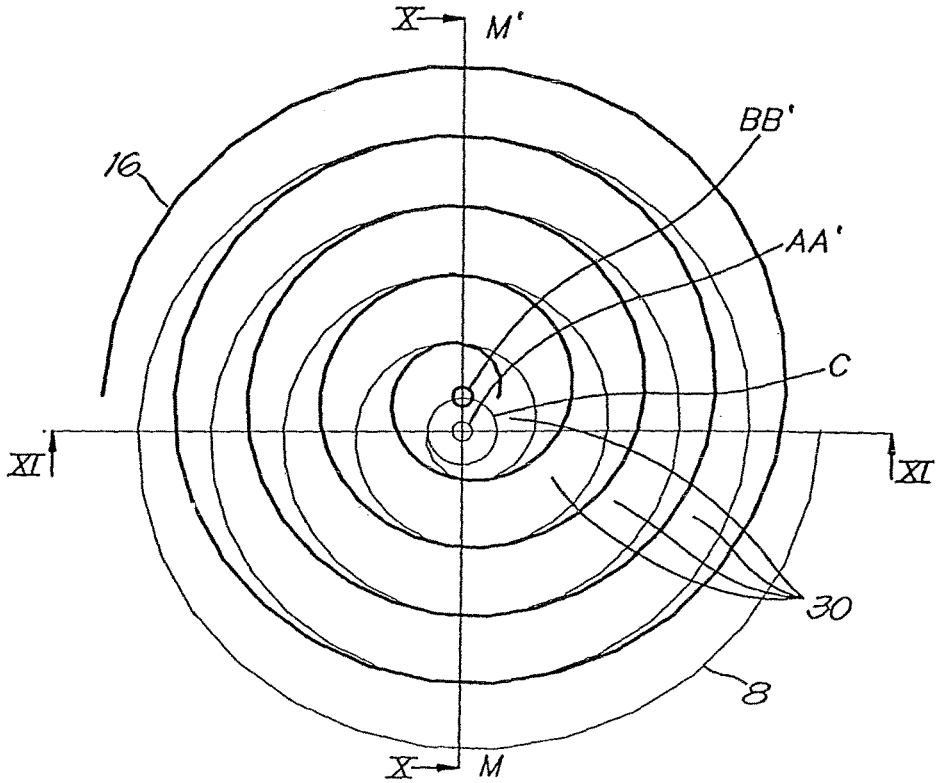

Similar diametrical positions of the central rotor axis BB' are shown in FIGS. 5 and 7 and the accompanying cross-sections are also shown in FIGS. 8 and 10 respectively.

Upon further examination it is also the case that in the one aforementioned position of the rotor 6 the minimum openings 29 are formed between an outward stator flank 10 and an inward rotor flank 19, as is the case for example in the positions of the rotor 6 in the stator 7, shown in FIGS. 4, 5 and 8, while in the second diametrical position of the rotor 6 in the stator 7, the minimum openings 29 are precisely reversed and are formed between an inward stator flank 11 and an outward rotor flank 18, such as is the case for example in the positions of the rotor 6 in the stator 7 shown in FIGS. 6, 7 and 10.

Hereby it is indeed also the case that the same sections of the rotor scroll 16 or the stator scroll 8 concerned are those that determine the minimum openings 29 in both diametrical positions, so that each deformation of the stator scroll 8 or the rotor scroll 16 has increasing effects on the size of the minimum openings 29, whereby furthermore these deformations in the two diametrical positions of the rotor 6 in the stator 7 result in opposite local effects, as will be illustrated further.

It is the places with a minimum opening 29 that define a compression chamber 30 in each case, whereby these compression chambers 30 decrease in volume towards the centre 27 of the scroll compressor 1.

The size of these minimum openings 29 is thus of great importance, as on the one hand there always has to be a minimum clearance in the scroll compressor in order to prevent contact between the stator scroll 8 and the rotor scroll 16, and on the other hand too large an instantaneous minimum opening 29 is coupled with large compression losses and leakage rates between successive compression chambers 30.

In such an instantaneous minimum opening at each local height Z with respect to the stator plate 13, the outward rotor flank 18 concerned and the inward stator flank 11 concerned, or the inward rotor flank 19 concerned and the outward stator flank 10 concerned are located at a certain radial distance S from one another.

Radial here means that the distance in the instantaneous sealing plane MM' is measured radially from one of the central axes AA' or BB' parallel to the stator plate 13 or the rotor plate 21.

These radial distances S define instantaneous local transverse internal clearances S during the movement of the rotor 6 at each moment, i.e. at each instantaneous position of the rotor 6 in the stator 7, as well as at each height Z.

In each position of the rotor 6 in the stator 7 there are different pairs of points on the flanks 10, 11, 18 and 19, of the stator scroll 8 and the rotor scroll 16 respectively, which in each case form an instantaneous local transverse internal clearance S in an instantaneous sealing plane MM'.

When going from an initial state of the stationary rotor 6 to a final state during nominal service of the scroll compressor 1, the pressures and temperatures in the scroll compressor 1 change significantly resulting in a deformation of the stator scroll 8 and the rotor scroll 16.

It is clear that such deformations of the stator scroll 8 and the rotor scroll 16 have an enormous effect on the instantaneous local transverse clearances S in the instantaneous minimum openings 29 of the scroll compressor 1.

According to the invention it is also the case that these deformations are best evaluated beforehand in order to give an initial form to the stator scroll 8 and/or the rotor scroll 16, which after deformation results in a desired or at least improved instantaneous final local transverse internal clearance S, compared to the situation in which no measure is taken, as is the case with the known scroll compressors 1.

Ideally, as an alternative or additionally, measures can be taken in order to counteract the deformations that relate to a change of the instantaneous final local internal transverse clearances S in the scroll compressor 1, for example by using an adapted composition of materials.

In order to clearly specify the initial forms when the scroll compressor 1 is stationary and the later deformations during the transition to the nominal operation of the scroll compressor 1, use will be made of terminology specified hereinafter, which moreover must be stripped of any possible intuitive or interpretive meanings.

First and foremost, it is assumed that both with the known scroll compressors and the scroll compressors 1 according to the invention, the intersecting lines 31 of the flanks 10, 11, 18 and 19 of the stator scroll 8 and rotor scroll 16 respectively with the stator plate 13 or the rotor plate 21 concerned, form spiral-shaped base edges 31.

These base edges 31 will be used as a reference to define the form of the stator scroll 8 and the rotor scroll 16, whereby it is pointed out that these base edges 31 are not static objects in practice.

Indeed, the absolute position of these base edges 31 with respect to an ideal fixed axis system will change due to a change of temperature in the stator plate 13 and the rotor plate 21 during a transition from the stationary scroll compressor 1 to the nominal operation of the scroll compressor 1, whereby this change must be taken into account in the further considerations.

Furthermore, the geometric location of the points through which a perpendicular line on the stator plate 13 intersects in an aforementioned spiral base edge 31 determines ideal spiral flanks 32.

In brief, the ideal spiral flanks 32 are flanks of the stator scroll 8 and the rotor scroll 16 devoid of any physical reality, which in all circumstances are perpendicular to the stator plate 13 or rotor plate 21 starting from the base edges 31, and these spiral flanks 32 would be ideal in the sense that the local transverse internal clearances S at the very least do not present any variation over the height with respect to the stator plate 13 or rotor plate 21 in all circumstances.

The radial distance ΔR between a point on a flank 18 or 19 of the rotor scroll 16 at a height Z with respect to the stator plate 13 and the closest ideal spiral flank 32 determines a local form of the rotor scroll 16, which hereinafter will be designated as the local rotor flank deviation ΔR.

In the same way the radial distance ΔT between a point on a flank 10 or 11 of the stator scroll 8 and the closest ideal spiral flank 32 at a height Z with respect to the stator plate 13 determines a local form of the stator scroll 8, which hereinafter will be designated as a local stator flank deviation ΔT.

Figure 12:
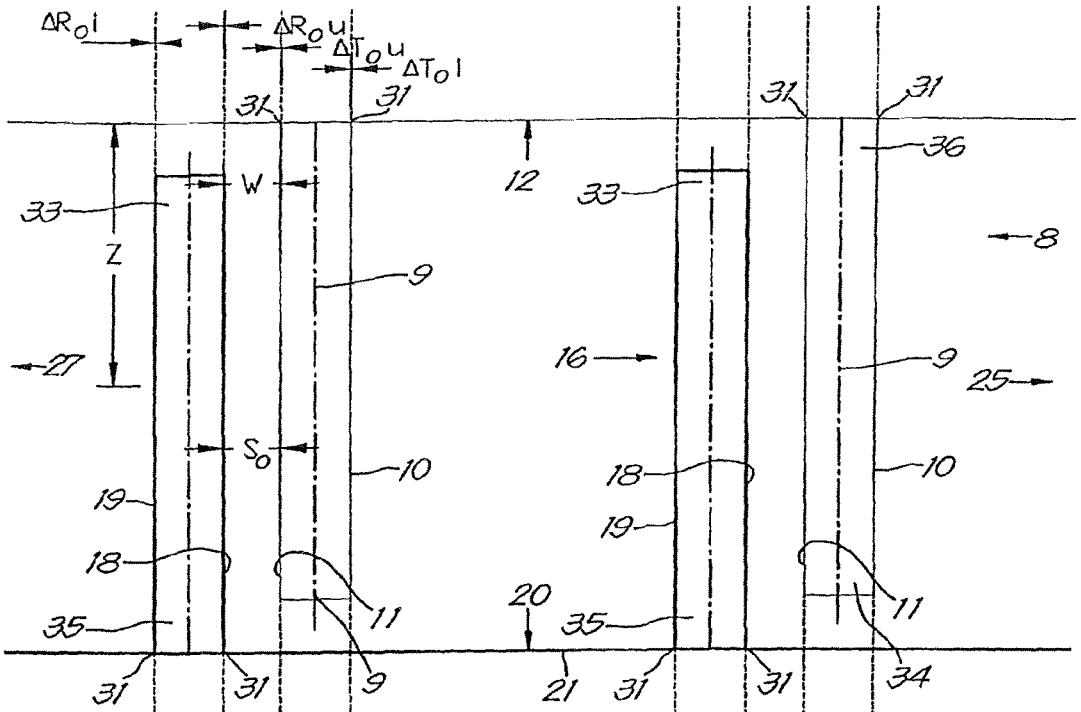
Fig. 12 (Prior Art)
FIGS. 12 and 13 show an enlargement of the section designated by F12/F13 in FIG. 8, respectively of a stationary known scroll compressor and a known scroll compressor in nominal service.

FIG. 12 shows, with a certain exaggeration of the clearances concerned, an enlargement of a section through a known scroll compressor 1 in a sealing plane MM' when the scroll compressor 1 is stationary, in a position of the rotor 6 in the stator 7, as shown for example in FIGS. 4 and 5.

Figure 14:
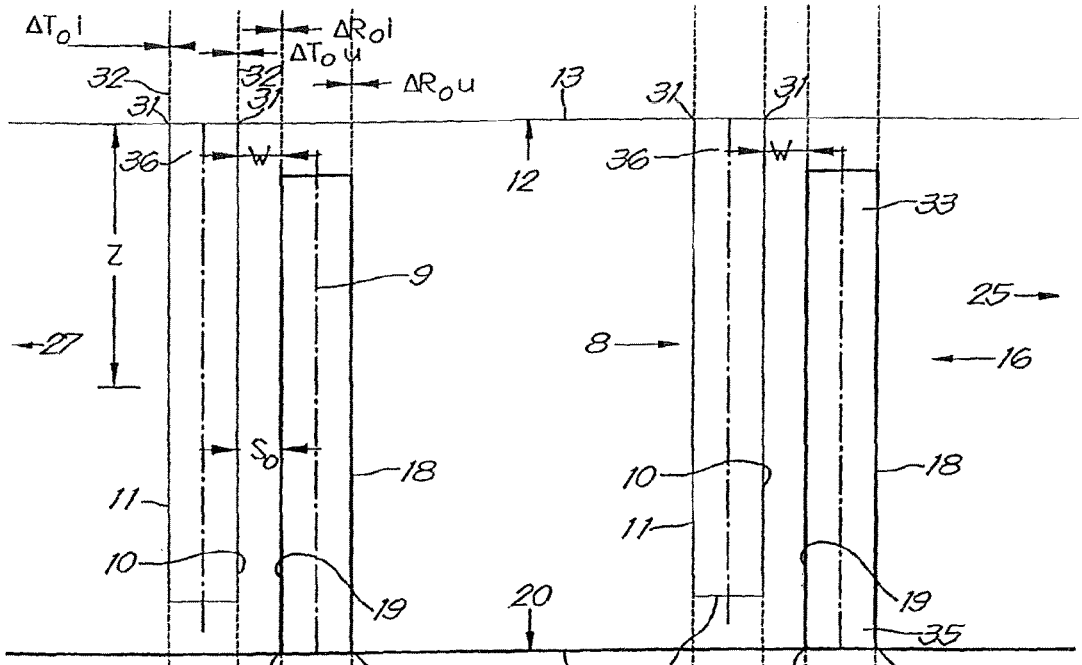
Fig. 14 (Prior Art)
FIGS. 14 and 15 also show an enlargement of the section designated by F14/F15 in FIG. 10, respectively of a stationary known scroll compressor and a known scroll compressor in full service.

Completely analogously, with a certain exaggeration of the clearances concerned, FIG. 14 shows an enlargement of a section through a known scroll compressor 1 in the same sealing plane MM' when the scroll compressor 1 is stationary, in the diametrically opposite position of the rotor 6 in the stator 7, as shown in FIGS. 6 and 7 for example.

If the forms of the stator scroll 8 and the rotor scroll 16 when stationary are designated with the subscript 0 and at nominal operation with the subscript f, then the following can be said.

With known scroll compressors 1 in the initial state when the scroll compressor 1 is stationary, irrespective of the position of the rotor 6 in the stator 7, or thus irrespective of the sealing plane MM', there is no local rotor flank deviation $\Delta R_0$ and no local stator flank deviation $\Delta T_0$, or there is thus a local rotor flank deviation $\Delta R_0$ or a local stator flank deviation $\Delta T_0$ equal to zero, and this at every height Z, Z', Z", etc, with respect to the stator plate 13.

Indeed, the known scroll compressors 1 are constructed with a stator scroll 8 and rotor scroll 16 that initially, when the scroll compressor is stationary, at least approximately have ideal spiral flanks 32.

A first consequence of this is that in principle there is no initial clearance deviation $\Delta S_0$ in the known scroll compressors 1.

A further consequence of this is also that the local transverse internal clearance S at each height Z, Z', Z", etc, in a sealing plane MM' is initially constant in such known scroll compressors 1 and is equal to a basic clearance W, which is defined by the radial distance W in the instantaneous sealing plane MM' concerned between the ideal spiral flanks 32, which are located closest to the flanks 11 and 18 or 10 and 19 concerned.

Thus there is no initial variation of the initial clearance profile over the height Z in the known scroll compressors 1 in the instantaneous minimum openings 29 when the scroll compressor 1 is stationary.

Figure 13:
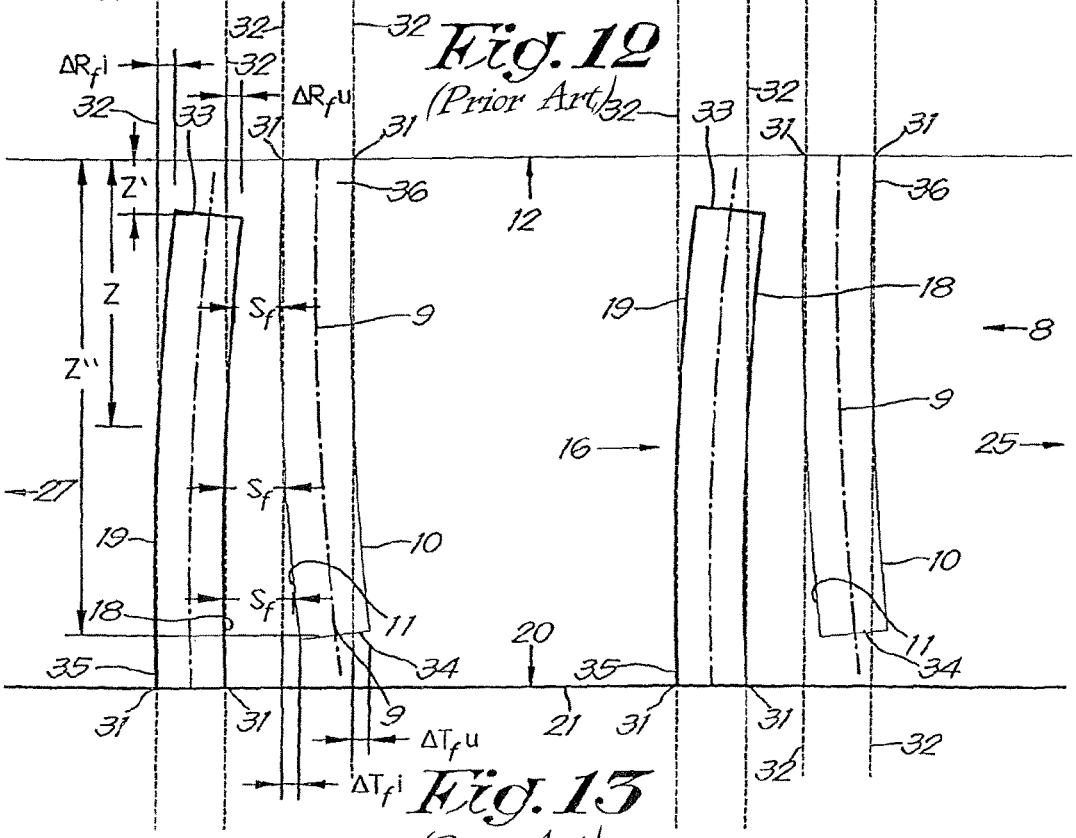
Fig. 13 (Prior Art)
Figure 15:
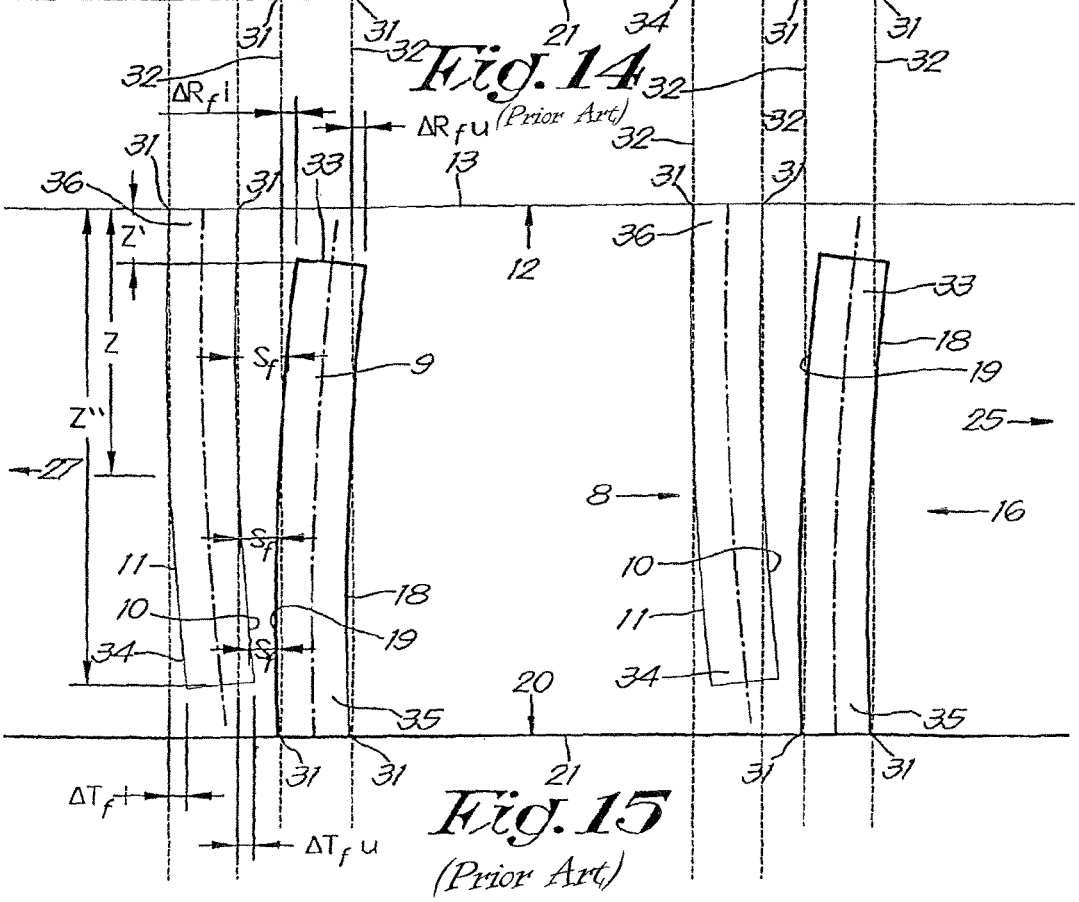
Fig. 15 (Prior Art)

During a transition from this stationary state to the nominal operation of the known scroll compressor 1, deformations occur of which typical cases are shown in FIGS. 13 and 15 by way of illustration.

As set out in the introduction, the rotor tips 33 and the stator tips 34 tend to deviate towards the outside 25 of the scroll compressor 1, because the pressures, as well as the temperatures, in the scroll compressor 1 increase towards the centre 27 and because a temperature gradient prevails in the height direction Z with an increasing temperature from a rotor base 35 to a rotor tip 33, as well as from a stator base 36 to a stator tip 34.

Depending on the position of the rotor 6 in the stator 7 this leads to opposite phenomena with regard to the final profile of the local transverse internal clearance $S_f$ over the height Z of the scrolls 8 and 16.

FIGS. 13 and 15 clearly show that at each height Z, Z', Z", etc, in an instantaneous sealing plane MM' there is a different instantaneous local transverse internal clearance S that consists of the interjacent instantaneous basic clearance W and an instantaneous local clearance deviation ΔS.

In brief each local transverse internal clearance S can be described as the sum of a desired instantaneous 'ideal' basic clearance W and a local clearance deviation ΔS that is due to local deviations of the rotor scroll 16 and the stator scroll 8.

At each height Z, Z', Z", etc, the instantaneous local clearance deviation ΔS is the difference between a local instantaneous rotor flank deviation ΔR and a local instantaneous stator flank deviation ΔT, whereby the principle is that deviations of the stator scroll 8 and the rotor scroll 16 of the same orientation have the same sign, more specifically a positive or negative sign depending on whether the deviation (from a point on the ideal spiral flank to the spiral flank) is towards the outside 25 or towards the centre 27 of the scroll compressor 1, and as a result it does not yield any clearance deviation ΔS if they are of the same magnitude.

In FIGS. 12 to 15, the stator scroll 8 and the rotor scroll 16 are constructed with parallel flanks or with a constant thickness, such that a stator flank deviation ΔTu of the outward stator flank 10 is always coupled with a stator flank deviation ΔTi of the inward stator flank 11 of the same magnitude and such that a rotor flank deviation ΔRu of the outward rotor flank 18 is always coupled with a rotor flank deviation ΔRi of the inward rotor flank 19 of the same magnitude.

In the case of FIG. 13 during nominal service of the scroll compressor, the instantaneous local transverse internal clearance S is formed by the distances concerned between the external rotor flank 18 and the internal stator flank 11.

Hereby the rotor tips 33 bend in the instantaneous sealing plane MM' concerned towards the opposite stator bases 36, such that the instantaneous local transverse internal clearance S at the rotor tips 33 decreases with respect to the basic clearance W, while the stator tips 34 bend away from the opposite rotor bases 35 such that the local internal clearance S at the stator tips 34 increases with respect to the basic clearance W.

At each height Z the instantaneous local stator flank deviation $\Delta T_f i$ concerned makes an instantaneous final contribution to the instantaneous final clearance deviation $\Delta S_f$ that increases the instantaneous final clearance $S_f$, while the instantaneous final local rotor flank deviation $\Delta R_f u$ makes a contribution to the instantaneous final clearance deviation $\Delta S_f$ that decreases the local transverse internal clearance $S_f$.

The instantaneous final local clearance deviation $\Delta S_f$ at a height Z is in this case is equal to the difference between the instantaneous final local stator flank deviation $\Delta T_f i$ and the instantaneous final local rotor flank deviation $\Delta R_f u$ at this height z".

This already shows that the position of the rotor 6 in the stator 7 plays an important role in determining the instantaneous final local clearance deviation $\Delta S_f$, because it is this position that determines which flanks 10 and 19 or 11 and 18 form the instantaneous final local clearance $S_f$.

Moreover, this position of the rotor 6 in the stator 7 determines which base edge 31 of a stator base 34, which in principle is immovable, is opposite a rotor tip 33, or which rotor base 35, which can also be considered as immovable, is opposite a stator tip 36.

This is clarified on the basis of FIG. 15 for example, whereby the central axis BB' of the rotor 6 is brought to a position that is diametrical with respect to its position shown in FIG. 13.

In this position of the rotor 6 the instantaneous final local transverse internal clearance $S_f$ is formed by the distances concerned between the internal rotor flank 19 and the external stator flank 10.

In this case of FIG. 15, the same deformation of the stator scroll 8 and the rotor scroll 16 as in the case of FIG. 13, more specifically a deformation whereby the rotor tips 33 and the stator tips 35 move towards the outside 25 of the scroll compressor 1, has the opposite effect on the instantaneous local transverse internal clearance $S_f$.

Indeed, in the instantaneous sealing plane MM' concerned of FIG. 15, the rotor tips 33 bend away from the opposite stator bases 36, such that the local transverse internal clearance $S_f$ increases at a small height Z' at the rotor tips 33 with respect to the basic clearance W, while the stator tips 34 bend towards the opposite rotor bases 35, such that the local internal clearance $S_f$ decreases at a large height Z" at the stator tips 34 with respect to the basic clearance W, whereby the clearance $S_f$ thus increases from the rotor bases 35, while in FIG. 13 the clearance S decreased from the rotor bases 35.

Hereby at each height Z the instantaneous local rotor flank deviation $\Delta R_f i$ concerned makes a contribution that increases the local transverse internal clearance $S_f$, while the instantaneous local stator flank deviation $\Delta T_f u$ makes a contribution that decreases the local transverse internal clearance $S_f$.

In the situation of FIG. 15, the instantaneous local clearance deviation $\Delta S_f$ at a height Z is equal to the difference between the instantaneous local rotor flank deviation $\Delta R_f i$ concerned and the instantaneous local stator flank deviation $\Delta T_f u$ concerned, whereby the instantaneous local transverse clearance $S_f$ is always equal to the basic clearance W plus the instantaneous local clearance deviation $\Delta S_f$.

If the initial situation is now compared to the final situation, the following can be stated.

When the known scroll compressor 1 is stationary, the form of the rotor flanks 18 and 19 and the stator flanks 10 and 11 initially do not present an initial local rotor flank deviation $\Delta R_0 i$ or $\Delta R_0 u$ and no initial local stator flank deviation $\Delta T_0 i$ or $\Delta T_0 u$ at any point.

When the known scroll compressor 1 is operating in nominal service, the stator scroll 8 and the rotor scroll 16 are deformed into a form whereby there are instantaneous final local stator flank deviations $\Delta T_f i$ and $\Delta T_f u$ and instantaneous final local rotor flank deviations $\Delta R_f i$ and $\Delta R_f u$ that are different to zero.

This means that over the entire surfaces of the spiral flanks 10, 11, 18 and 19, the stator flank deviations $\Delta T_f i$ and $\Delta T_f u$ and the rotor flank deviations $\Delta R_f i$ and $\Delta R_f u$ have increased after the scroll compressor 1 has been brought to nominal service compared to the form when stationary.

In brief, during nominal operation of the known scroll compressors 1, the spiral flanks 10, 11, 18 and 19 deviate more from the ideal spiral flanks than when the known scroll compressors 1 are stationary, and this at each point of the flanks concerned.

Moreover, as practically no deviation is possible at the stator bases 36 and the rotor bases 35, this yields a strong variation of the circulating clearance profile over the height Z, as demonstrated above.

FIGS. 16 to 19 show, analogously to FIGS. 12 to 15 respectively, the corresponding situations in a scroll compressor 1 according to the invention.

Figure 16:
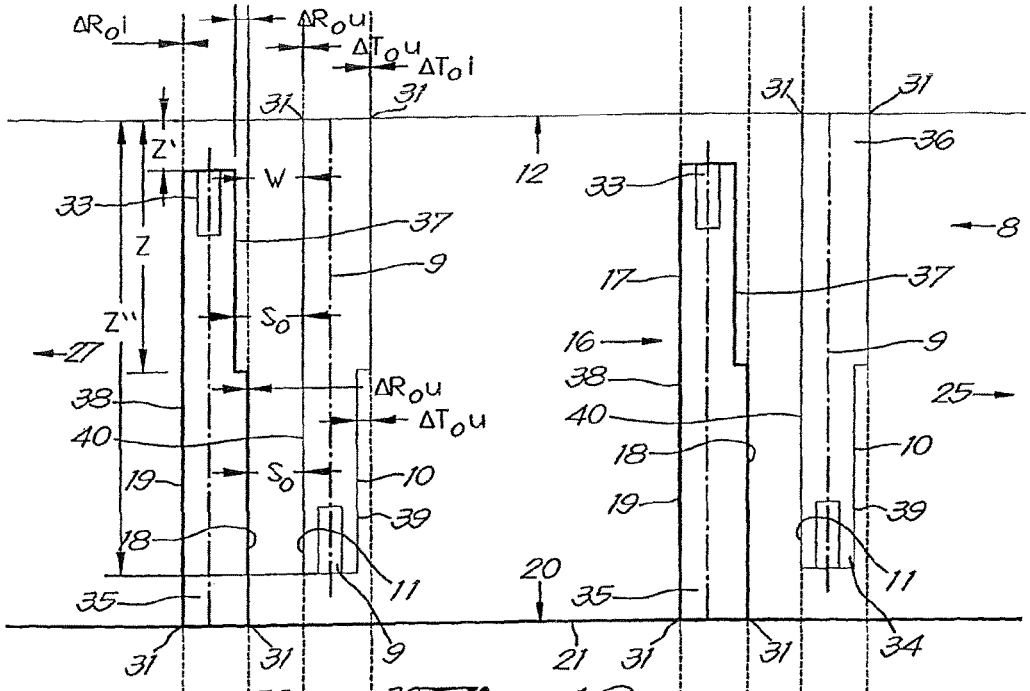
FIGS. 16 to 19, analogous to FIGS. 12 to 15, illustrate the deformation of the stator scroll and rotor scroll in a transition from a stationary state to nominal service in a first embodiment of a scroll compressor according to the invention.
Figure 18:
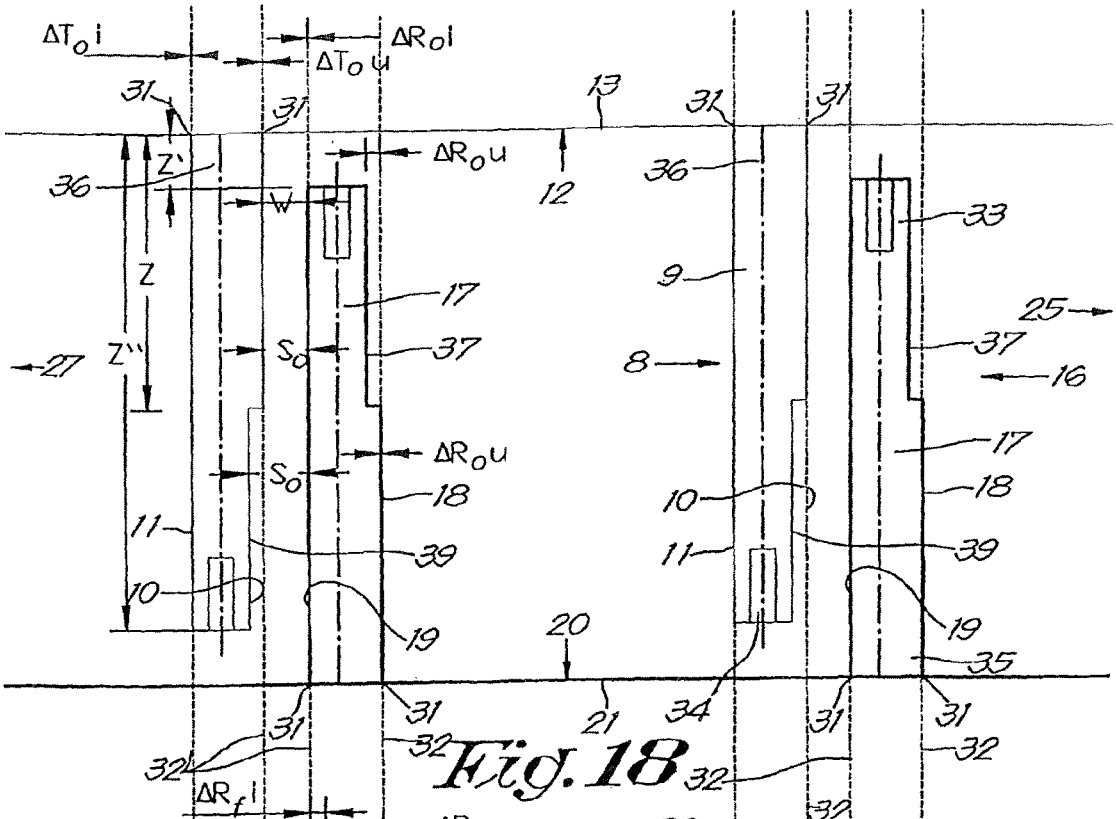

In the embodiment shown this scroll compressor 1 is provided with an adapted flank section 37, more specifically a section of the outward rotor flank 18 whose form is initially adapted at each point of the adapted flank section 37 concerned in an initial stationary state of the scroll compressor 1, shown in FIGS. 16 and 18 for diametrical positions of the rotor 6, by there being a local initial rotor flank deviation $\Delta R_0 u$ that is different from zero, whereby in particular this $\Delta R_0 u$ is less than zero.

In other words it can be said that the adapted flank section 37 of the outward rotor flank 18 presents, as of a certain height Z, a certain setback F with respect to the ideal spiral flanks 23 in the direction of the central axis BB'.

The adapted flank section 37 concerned also has a discontinuous profile, whereby more specifically the thickness G of the rotor scroll 16 decreases stepwise in the direction from the rotor base 35 to the rotor tip 33, and in this case has one step change over the height Z.

Moreover, the rotor scroll 16 is profiled such that the opposite flank section 38 of the inward flank 19 of the rotor scroll 16 is made flat when stationary and is in a perpendicular position on the rotor plate 21, so that the rotor scroll 16 has a thickness K that is greater at the stator base 35 than at the stator tip 33.

In a completely similar way, in the embodiment shown the outward stator flank 10 is provided with an adapted flank section 39 whose form is initially adapted by there being, at each point of the adapted flank section 39 concerned in an initial stationary situation of the scroll compressor 1, a local initial stator flank deviation $\Delta T_0 u$ that is different to zero, whereby in particular this $\Delta T_0 u$ is less than zero.

The adapted flank section 39 also has a discontinuous profile with the same setback F, whereby the thickness L of the stator scroll 8 over the height Z has one step change in the direction from the stator base 36 to the stator tip 34.

At the other inward flank 11, the stator scroll 8 also has an opposite flank section 40, which is made flat when stationary and is in a perpendicular position on the stator plate 13, so that the stator scroll 8 has a thickness L that is greater at the stator base 36 than at the stator tip 34.

In brief, with such a scroll compressor 1 according to the invention, at least certain flank sections 37 and 39 initially deviate from the ideal spiral flanks 32 when stationary.

Figure 17:
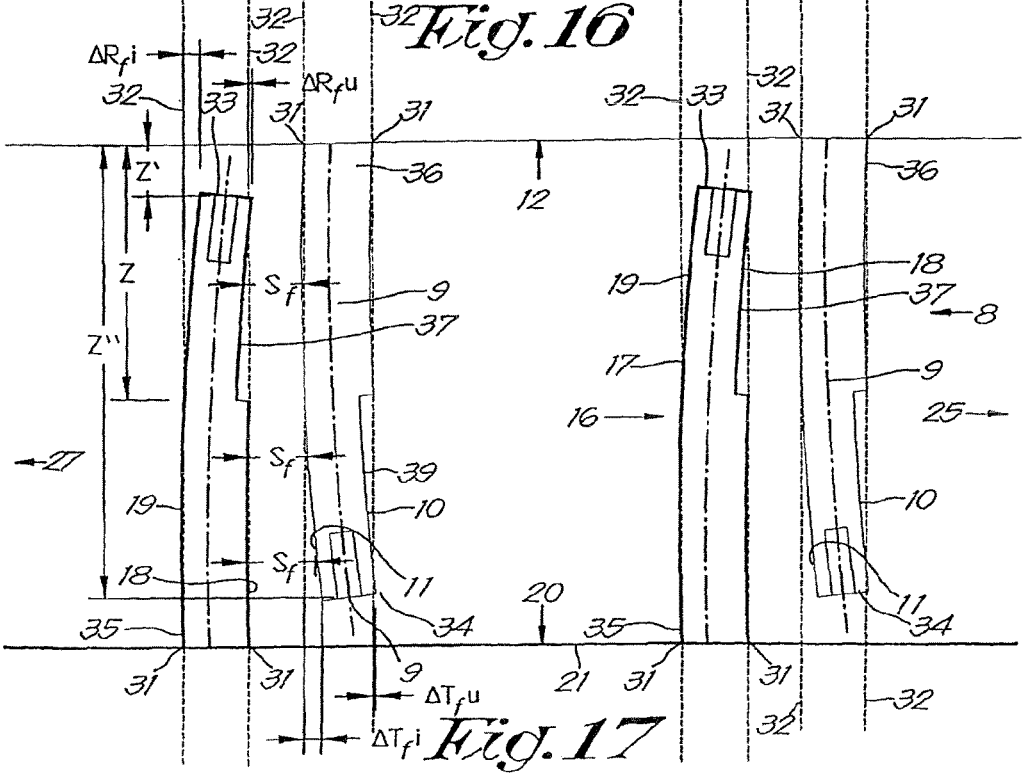
Figure 19:
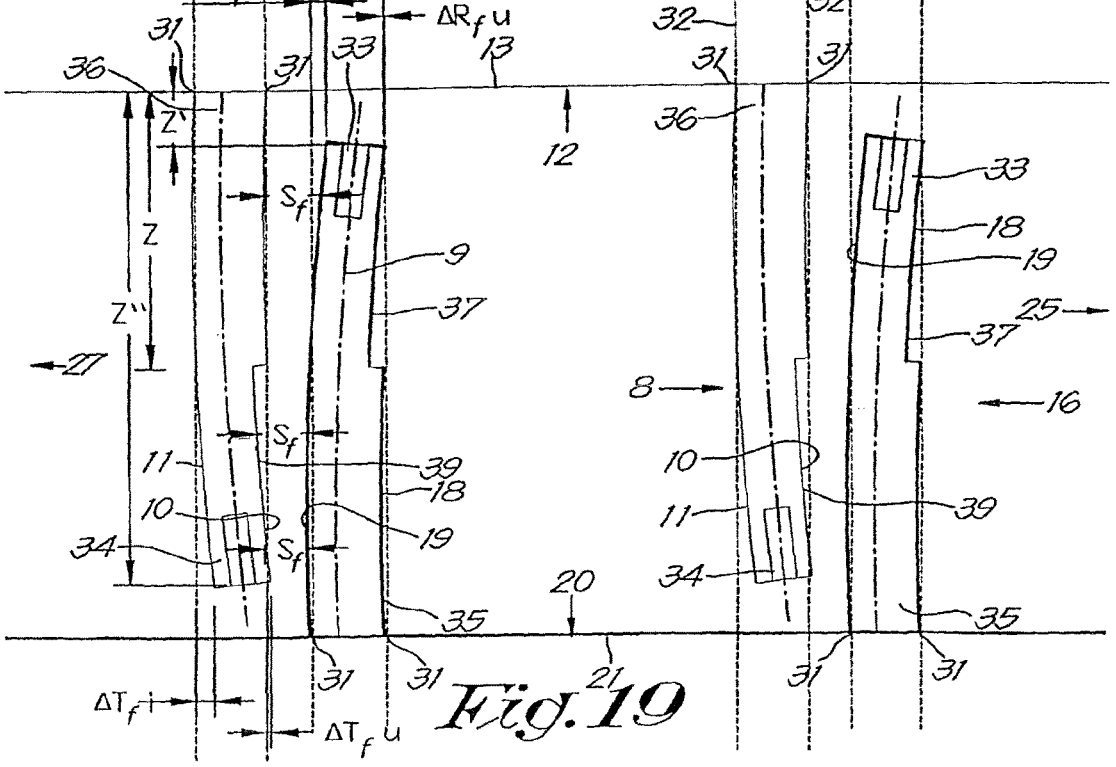
Figure 20:
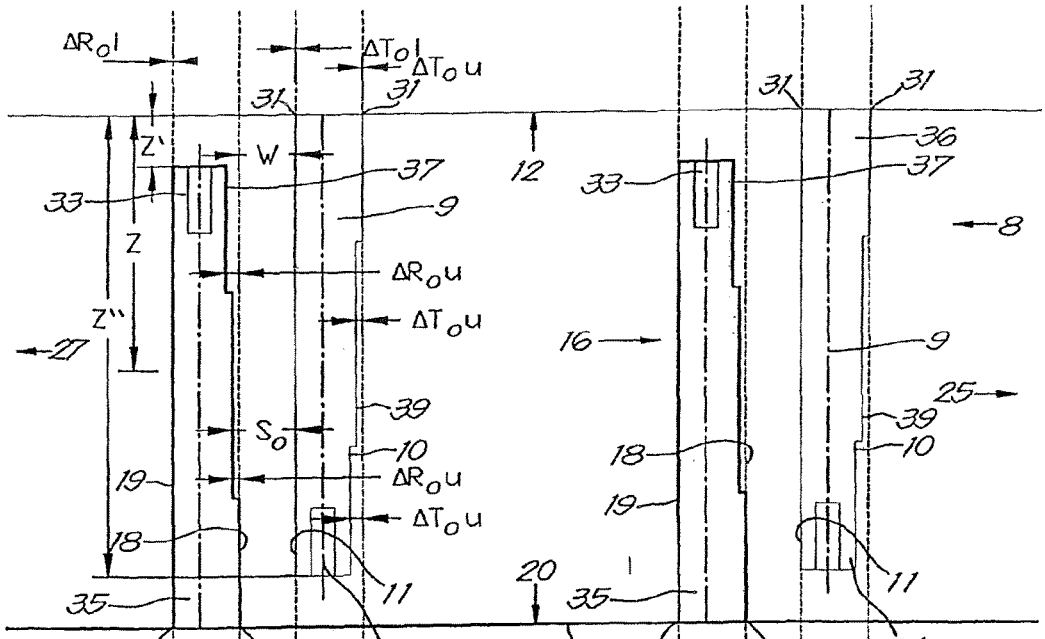
FIGS. 20 to 23, FIGS. 24 to 27, FIGS. 28 to 31 and FIGS. 32 to 35, analogous to FIGS. 16 to 19, each time show the different respective states for other embodiments of a scroll compressor according to the invention.
Figure 21:
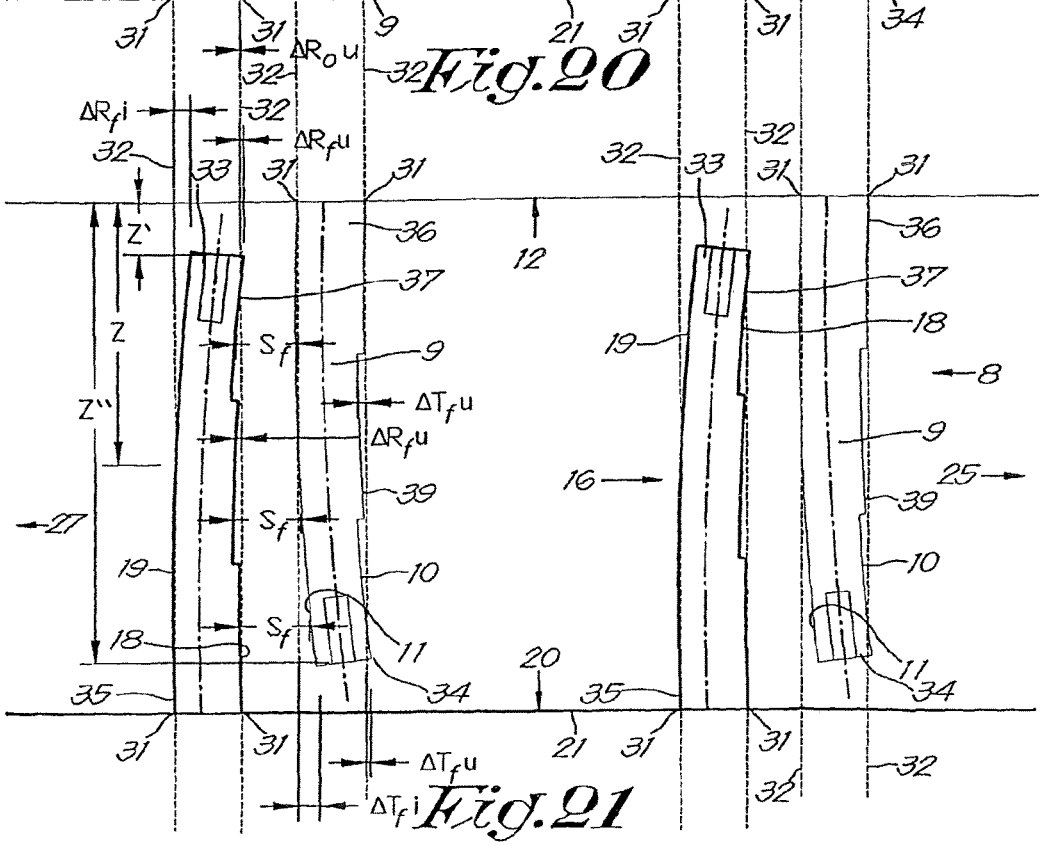
Figure 22:
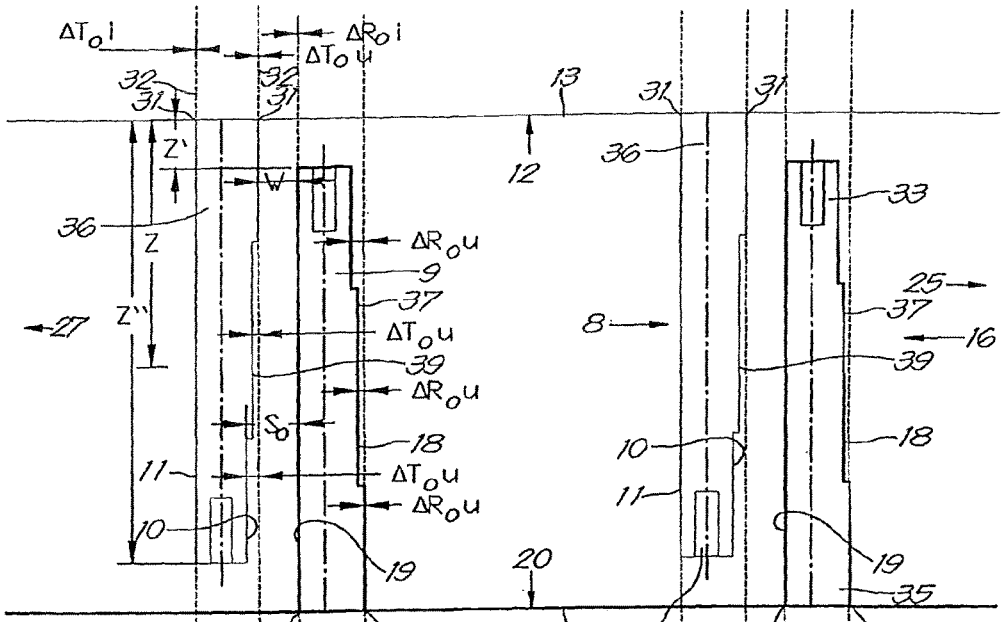
Figure 23:
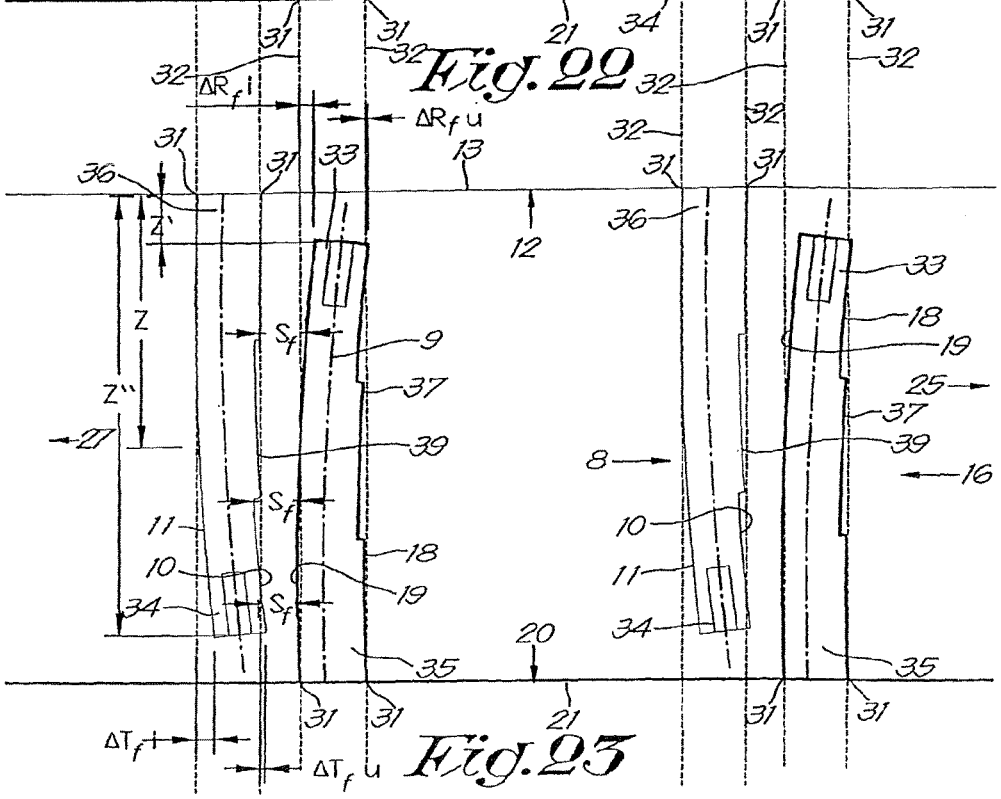
Figure 24:
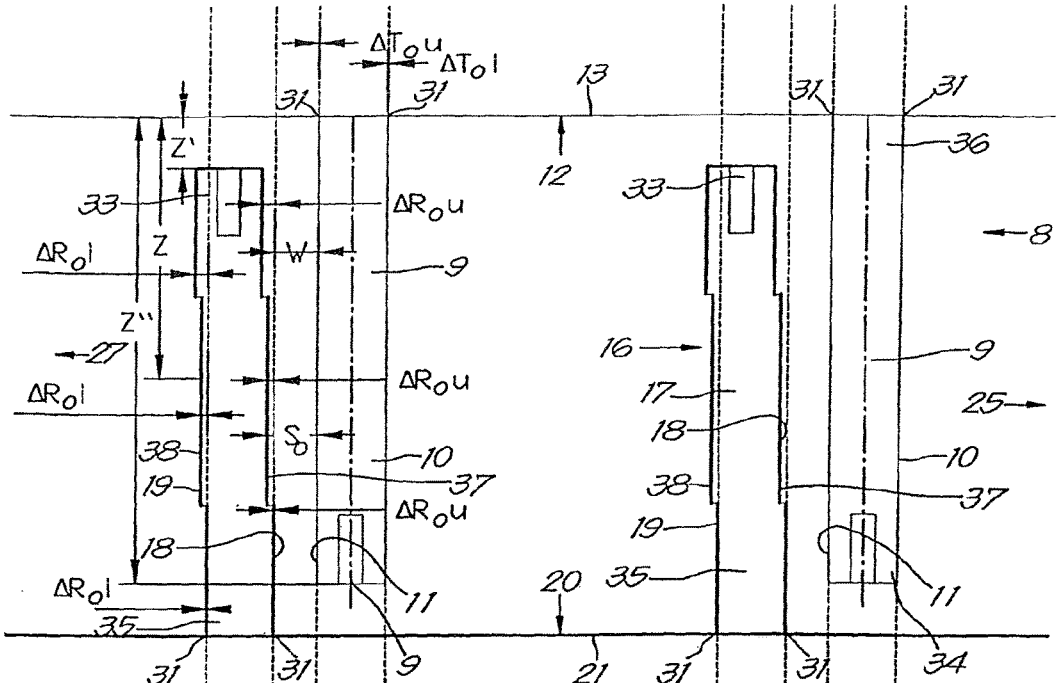
Figure 25:
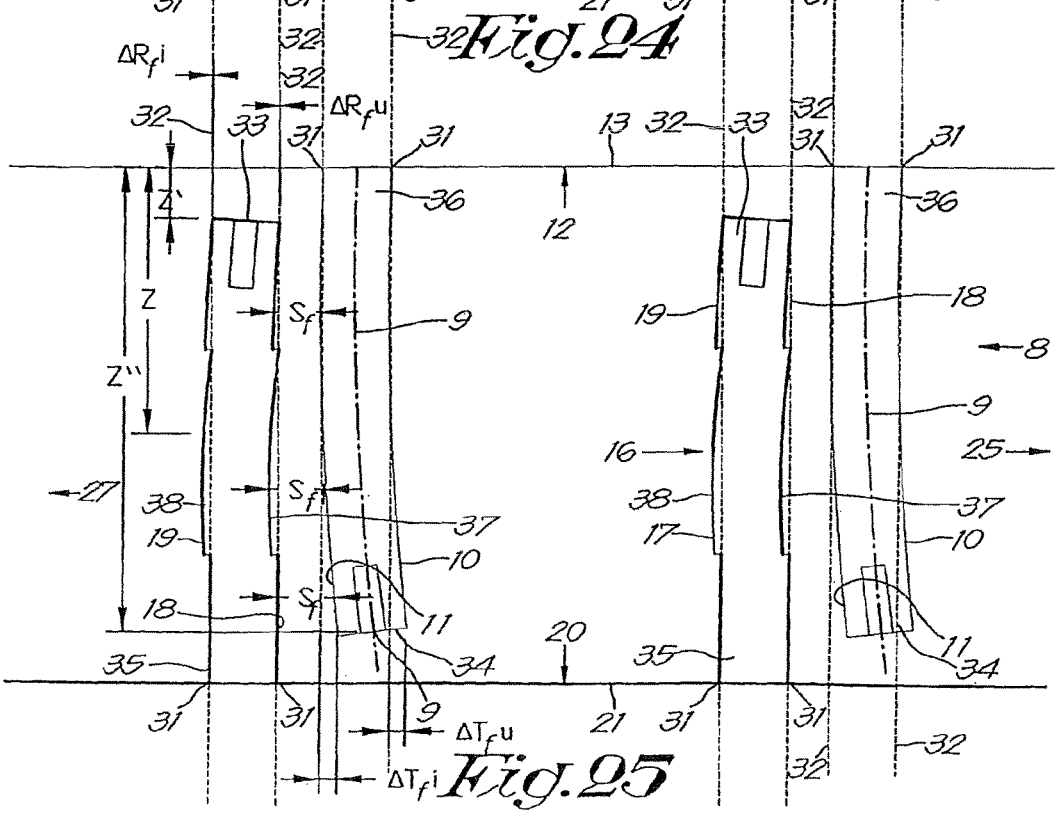
Figure 26:
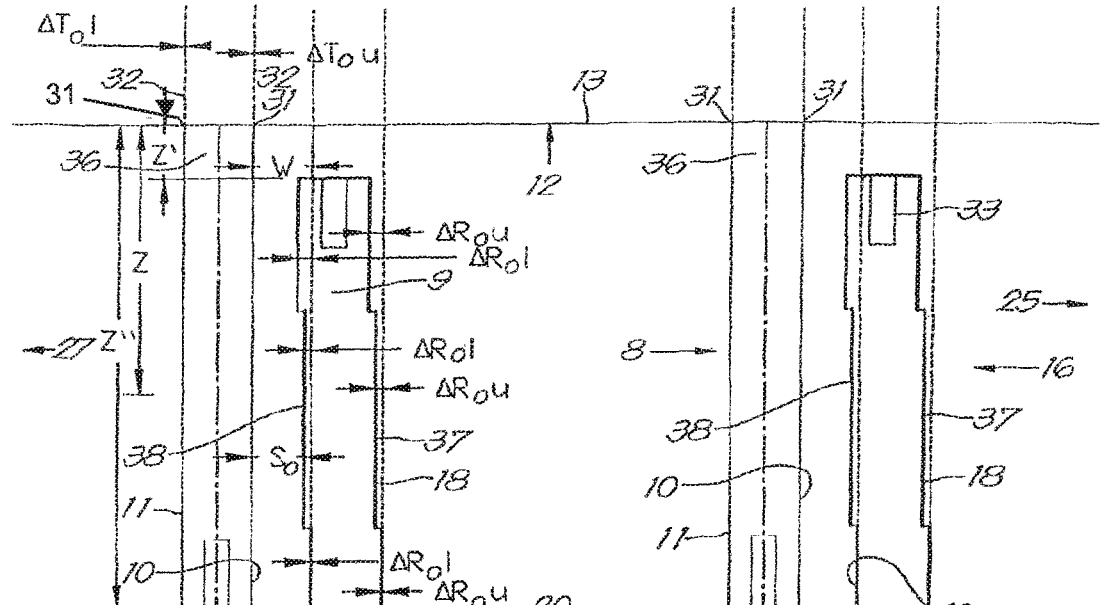
Figure 27:
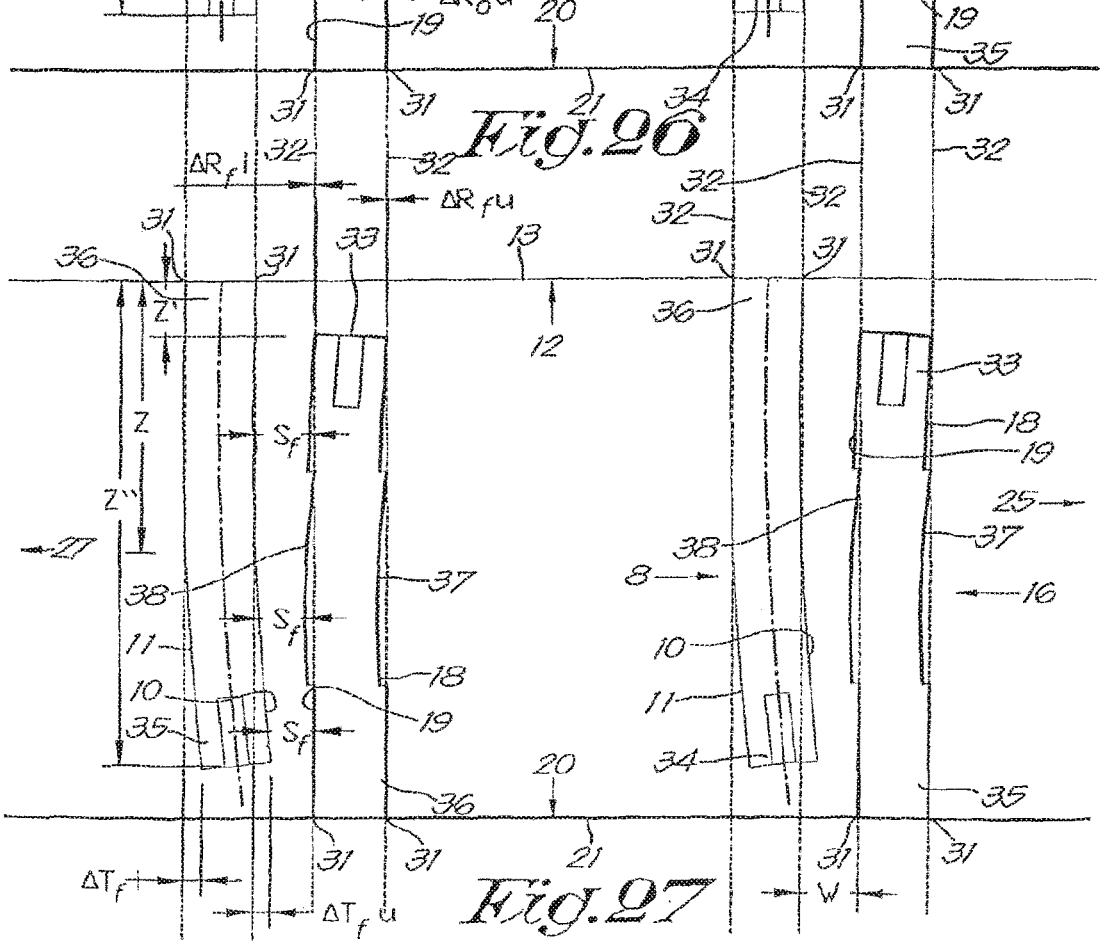
Figure 28:
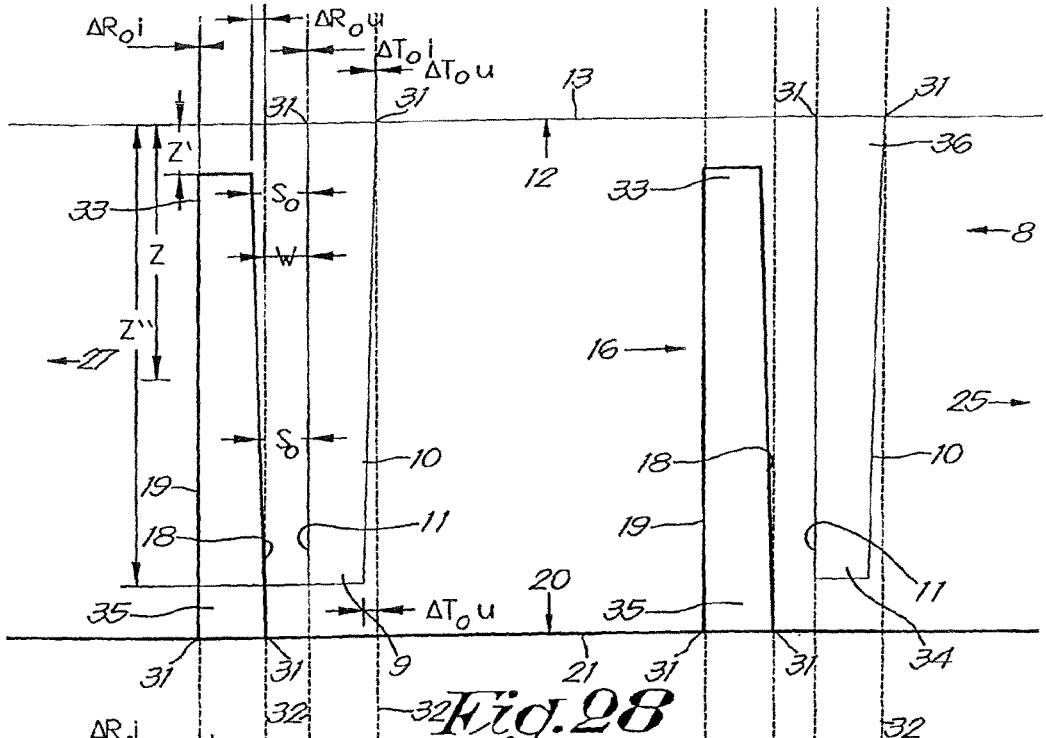
Figure 29:
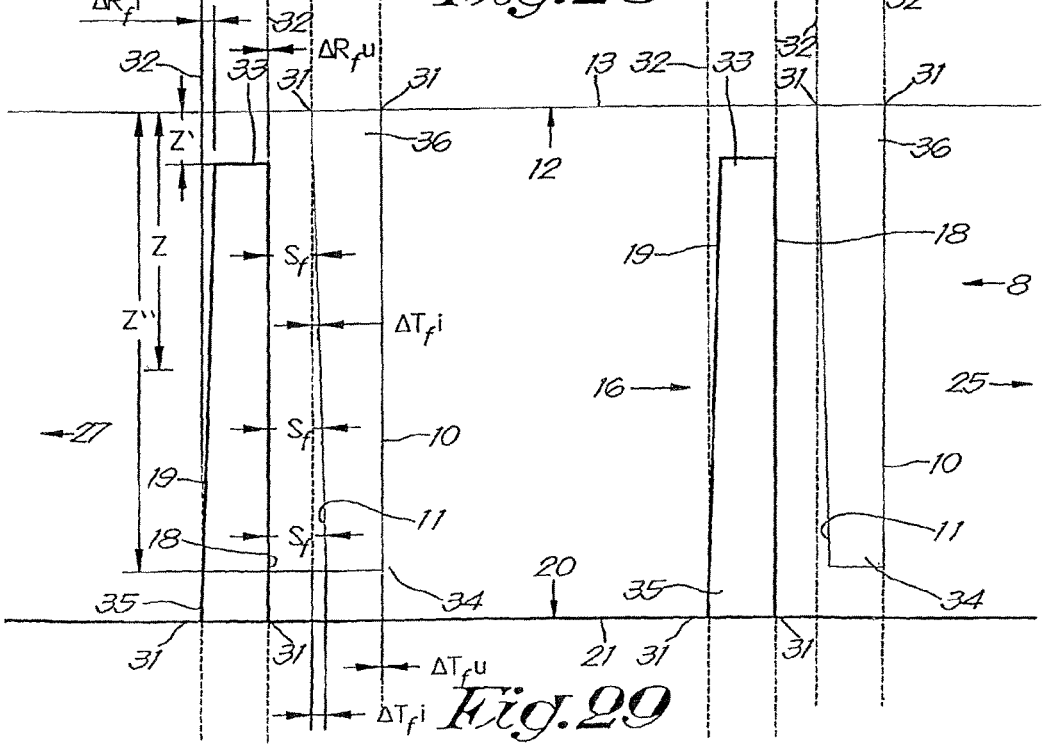
Figure 30:
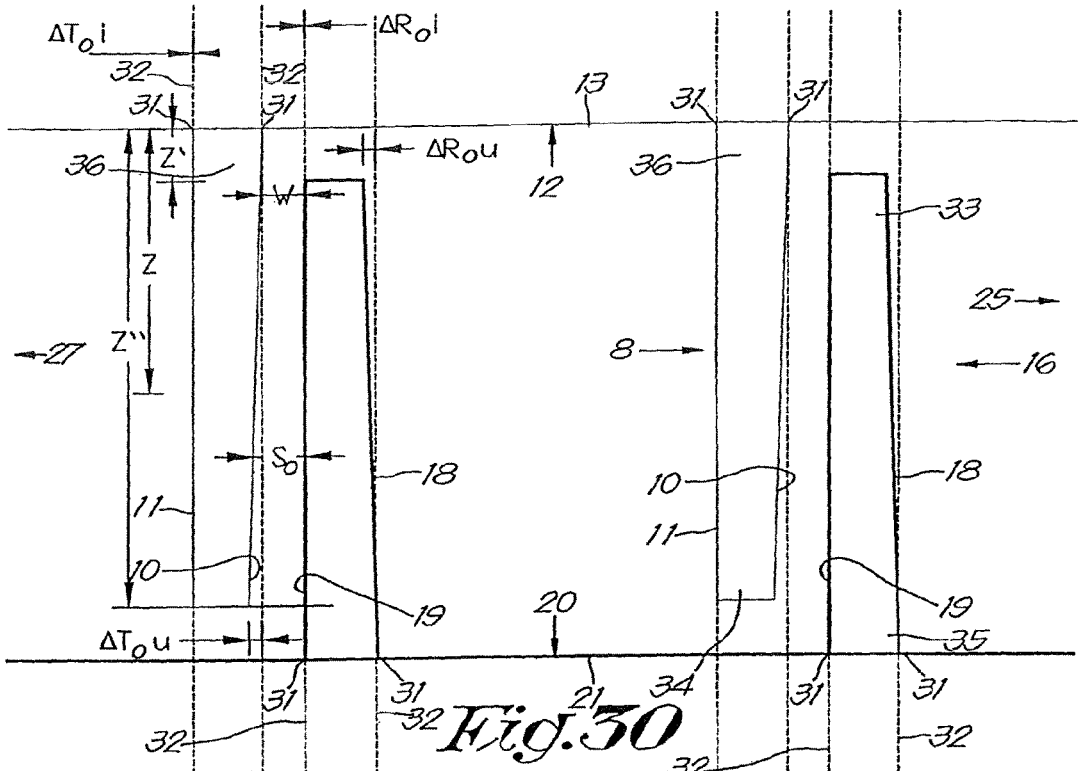
Figure 31:
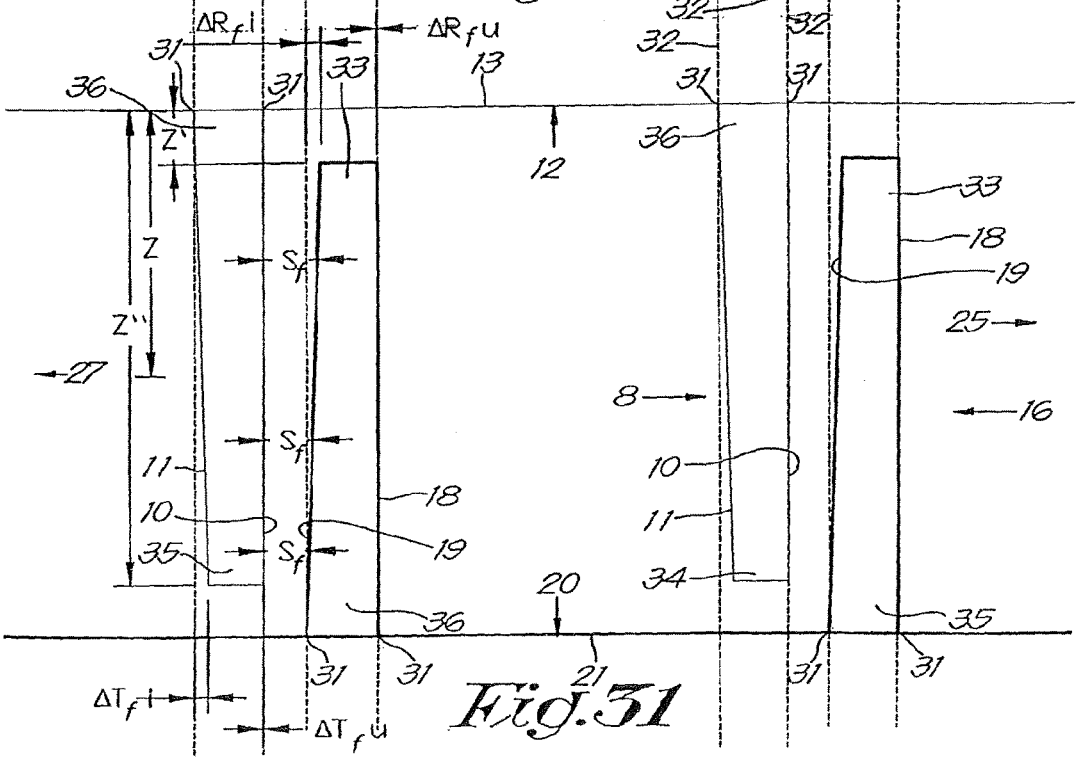

When the scroll compressor 1 according to the invention goes from the initial stationary state to a final state in nominal service, the stator scroll 8 and the rotor scroll 16 deform, as shown in more detail in FIGS. 17 and 19.

According to the invention this deformation is such that during the movement of the rotor 6 in nominal service, at each point of an aforementioned adapted rotor flank section 37 and stator flank section 39, and in each position of the rotor 6, there is an instantaneous final local rotor flank deviation $\Delta R_f u$ and an instantaneous final local stator flank deviation $\Delta T_f u$ respectively, which in absolute value is less than the corresponding local initial rotor flank deviation $\Delta R_0 u$ and the local initial stator flank deviation $\Delta T_0 u$ respectively at the same point when the rotor 6 is stationary in the corresponding position.

In brief, when operating the scroll compressor in nominal service, the adapted flank sections 37 and 39 concerned are deformed into a form that fits more closely to the ideal spiral flanks 32.

It is felt intuitively here that such a deformation results in a less varying circulating clearance profile over the height Z in the scroll compressor 1.

The adaptations of the aforementioned flank sections 37 and 39 and the local deformations following from this however are not so simply directly linked to their influence on the instantaneous final local internal clearances $S_f$ and accompanying instantaneous final clearance deviations $\Delta S_f$.

Indeed, when the rotor 6 for example is in a position corresponding to that shown in FIG. 17, the instantaneous final local internal clearance $S_f$ is determined by the radial distance $S_f$ between the outward rotor flank 18, that is provided with an adapted flank section 37 and the inward stator flank 11, which in this case is constructed like the known scroll compressors 1.

Therefore, in the position of FIG. 17, between the rotor tip 33 and the opposite stator base 36 in every case there is an improvement of the instantaneous final local transverse clearance $S_f$ compared to the situation of FIG. 13 in the known scroll compressors 1, where no flank section has been initially adapted, as the opposite stator base 36 is barely deformed, while in this embodiment the rotor tip 33 is closer to the ideal spiral flanks 32 due to the deformation.

Due to a good choice of the adaptations to the flank section 37 of the rotor scroll 16 it can be ensured that in the state concerned the instantaneous final local transverse clearance $S_f$ at the rotor tip 33 is equal to the basic clearance W and there is thus no local instantaneous final circulating clearance deviation $\Delta S_f$.

The instantaneous final local transverse clearance $S_f$ between the rotor base 35 and the opposite stator 34 in this position of the rotor 6 according to FIG. 17, is barely changed with respect to what was the case in the known scroll compressor 1 shown in FIG. 13, and the instantaneous final local transverse clearance $S_f$ at the height Z" at the rotor base 35 is even possibly somewhat increased with respect to what was the case in the known scroll compressor 1 on account of the adaptations to the opposite stator scroll 6.

Hereby an adapted flank section 39 is provided at the stator tip 34 where the thickness of the stator scroll 8 is reduced with respect to the thickness of the stator scroll 8 in a similar known scroll compressor 1, such that the stator tip 34 in the scroll compressor 1 according to the invention in the position of FIG. 17 possibly bends out even further to the outside 25 of the scroll compressor 1 than is the case with the known scroll compressor 1 shown in FIG. 13.

In the other position of the rotor shown in FIG. 19, diametrically opposite the position of FIG. 17, a similar phenomenon occurs.

More specifically, the instantaneous final local transverse clearance $S_f$ in this position of FIG. 19 is the difference in the radial distance $S_f$ at a certain height Z between the external stator flank 11 and the internal rotor flank 19.

The adapted flank section 39 according to the invention of the stator flank 8 hereby takes on a form, in nominal service, at the stator tip 34 that is closer to an ideal flank section 32 compared to its initial form, whereby the opposite rotor base 35 is practically not deformed, so that the instantaneous final local transverse clearance $S_f$ at the stator tip 34 at a height Z" is closer to the basic clearance W and there is a local circulating clearance deviation $\Delta S_f$ at this height Z" that is practically zero.

The stator base 36 practically does not deform during a transition from the stationary state to nominal service of the scroll compressor 1, while the opposite rotor tip 33 undergoes a deformation that is at least as large as in the known scroll compressors 1, as the internal rotor flank 19 is not provided with an adapted flank section while the rotor tip 33 is made narrower, such that the instantaneous final local transverse clearance $S_f$ in the case of FIG. 19 at the stator base 36 is at least as large locally as in the known scroll compressors, also with a relatively large clearance deviation $\Delta S_f$ at this height Z'.

In brief, in the one position of the rotor 6 according to FIGS. 16 and 17 the adapted flank section 37 of the outward rotor flank 18 makes a smaller contribution to the instantaneous final clearance deviation $\Delta S_f$, while the other adapted flank section 39 of the inward stator flank 11 makes the same or a somewhat larger contribution to the instantaneous final clearance deviation $\Delta S_f$ in this position, compared to what happens in the known scroll compressors 1.

In another position of the rotor 6, shown in FIGS. 18 and 19, it is precisely the reverse.

Nevertheless, it turns out to be possible according to the invention, using computer calculations with finite element methods, to design adapted flank sections 37 or 39 with an additional deviant form and to make a prediction of the circulating clearance profile in an instantaneous sealing plane MM' during nominal operation, whereby a generally better instantaneous final circulating clearance profile is obtained, whereby the instantaneous final local transverse clearance $S_f$ varies less over the height Z in an instantaneous sealing plane MM' and in general approximates the basic clearance W more closely than is the case with the known scroll compressors 1.

The positive effect of the adaptation of one or more flank sections of the rotor scroll 16 or the stator scroll 8 on the instantaneous final circulating clearance deviation $\Delta S_f$ is embodied in the contribution that the deformation of the flank section concerned makes to the total clearance deviation $\Delta S_f$.

In the case of FIG. 16 for example, the initial rotor flank deviation $\Delta R_0u$ in the flank section 37 at specific heights Z is less than zero, whereby the absolute value of this rotor flank deviation $\Delta R_0u$ makes a certain initial local contribution $\|\Delta R_0u\|$ to an instantaneous initial local clearance deviation $\Delta S_0$ at the height Z concerned in the instantaneous sealing plane MM' concerned.

During the operation of the scroll compressor 1 in nominal service, the outward rotor flank 18 concerned is deformed, which results in a final local rotor flank deviation $\Delta R_fu$ in the flank section 37 at the different heights Z concerned that is always less than zero, but the absolute value of which makes a certain final local contribution $\|\Delta R_fu\|$ to an instantaneous final local clearance deviation $\Delta S_f$ at the height Z concerned in the instantaneous sealing plane MM' concerned, which is less than the absolute value of the aforementioned initial local contribution $\|\Delta R_0u\|$.

This positive effect as a result of the adapted flank section 37 on the instantaneous final local internal clearance S is only present in certain positions of the rotor 6 in the stator 7, as shown in FIG. 19 for example, in which position of the rotor according to FIG. 19 the adapted flank section 39 yields a positive effect, as set out above.

In the known scroll compressors 1, however, in no flank section of the rotor scroll 16 or the stator scroll 8 and in no position of the rotor 6 in the stator 8 is there such a positive effect on the final circulating clearance deviation $\Delta S_f$, as the two flanks 10 and 19 or 11 and 18, which define a minimum opening 29 and between which there is an instantaneous final local transverse clearance $S_f$, in all circumstances deviate more from the ideal spiral flanks 32 than in the initial state, whereby this initial state rather corresponds to the "ideal".

The embodiment of a scroll compressor 1 according to the invention discussed so far is of course only a simple example, whereby in adapted flank sections 37 and 39, the thickness K of the rotor scroll 16 concerned or the thickness L of the stator scroll 8 respectively has been initially reduced locally with a discontinuous step change F.

According to the invention it is not excluded to adapt the flank sections of the rotor scroll 16 and the stator scroll in a different way, and preferably more sophisticated way, in order to give an adapted initial form.

In general it is not excluded according to the invention that at least one of the stator flanks 10 and 11 or the rotor flanks 18 or in its entirety forms an aforementioned flank section 37 or 39 respectively, or that more than one of the stator flanks 10 and 11 or rotor flanks 18 and 19 in their entirety form an aforementioned adapted flank section 37 of 39.

Preferably according to the invention, the initial form of the scroll compressor is designed such that for at least some of the positions, and ideally for all positions adopted by the rotor 6 during its movement, the local transverse internal clearances S over the height Z of the stator flank 10 or 11 and rotor flank 19 or 18 are constant in nominal service, so that these local transverse internal clearances S over the height Z present a final instantaneous profile without variation, or in other words with a variation equal to zero in the positions concerned.

A few simple lines of thought are illustrated in the remaining FIGS. 20 to 35.

In the example of FIGS. 20 to 23 the outward rotor flank 18 is provided with an adapted flank section 37 that also has a discontinuous profile, such as in the foregoing embodiment, but whereby the thickness K of the rotor scroll 16 at the flank section 37 has a number of step changes over the height Z, more specifically two in this case.

Such step changes are preferably of the order of magnitude of 10 μm and 300 μm.

In this way a more accurate fit can be obtained of the flank section 37 concerned of the rotor scroll 16 in the final situation during nominal operation of the scroll compressor, with a less varying instantaneous final local internal clearance $S_f$ and instantaneous final clearance deviation $\Delta S_f$ of the scroll compressor 1 at the location of the flank section 37, at least for certain positions of the rotor 6 in the stator 7.

Analogously the outward stator flank 10 is also provided with an adapted flank section 39 that also has a discontinuous profile whereby the thickness L of the stator scroll 8 in the flank section 39 has two step changes over its height Z, with similar aforementioned effects on the instantaneous final clearance $S_f$ and instantaneous final clearance deviation $\Delta S_f$.

Of course by providing the adapted flank sections, whereby more and more discontinuous step changes are provided, the expected deformation is adapted in an increasingly detailed way.

In extremis this leads to designs whereby an adapted flank section of a stator flank 10 or 11 or a rotor flank 18 has a continuous profile, as is the case for example in FIGS. 28 to 35, whereby in the case of these FIGS. 28 to 35 the outward rotor flank 18 and the outward stator flank 11 initially present a certain inclination, while the inward rotor flank 19 and the inward stator flank 10 are initially perpendicular with respect to the rotor plate 21 and stator plate 13 respectively.

Figures 32, 33:
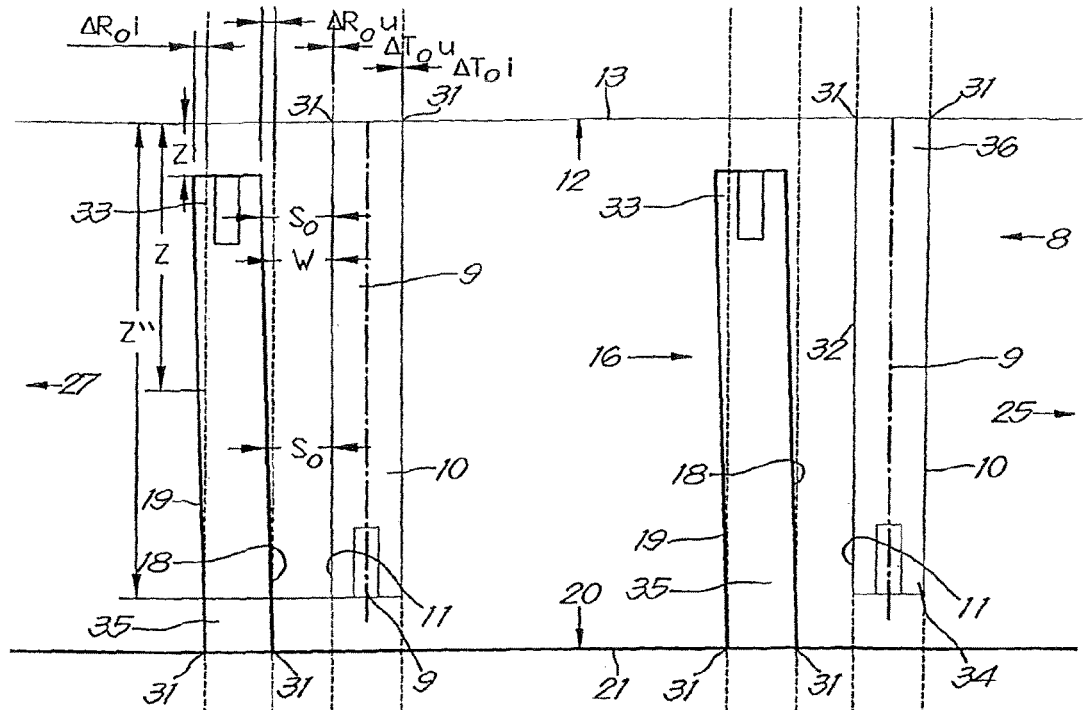
Figures 34, 35:
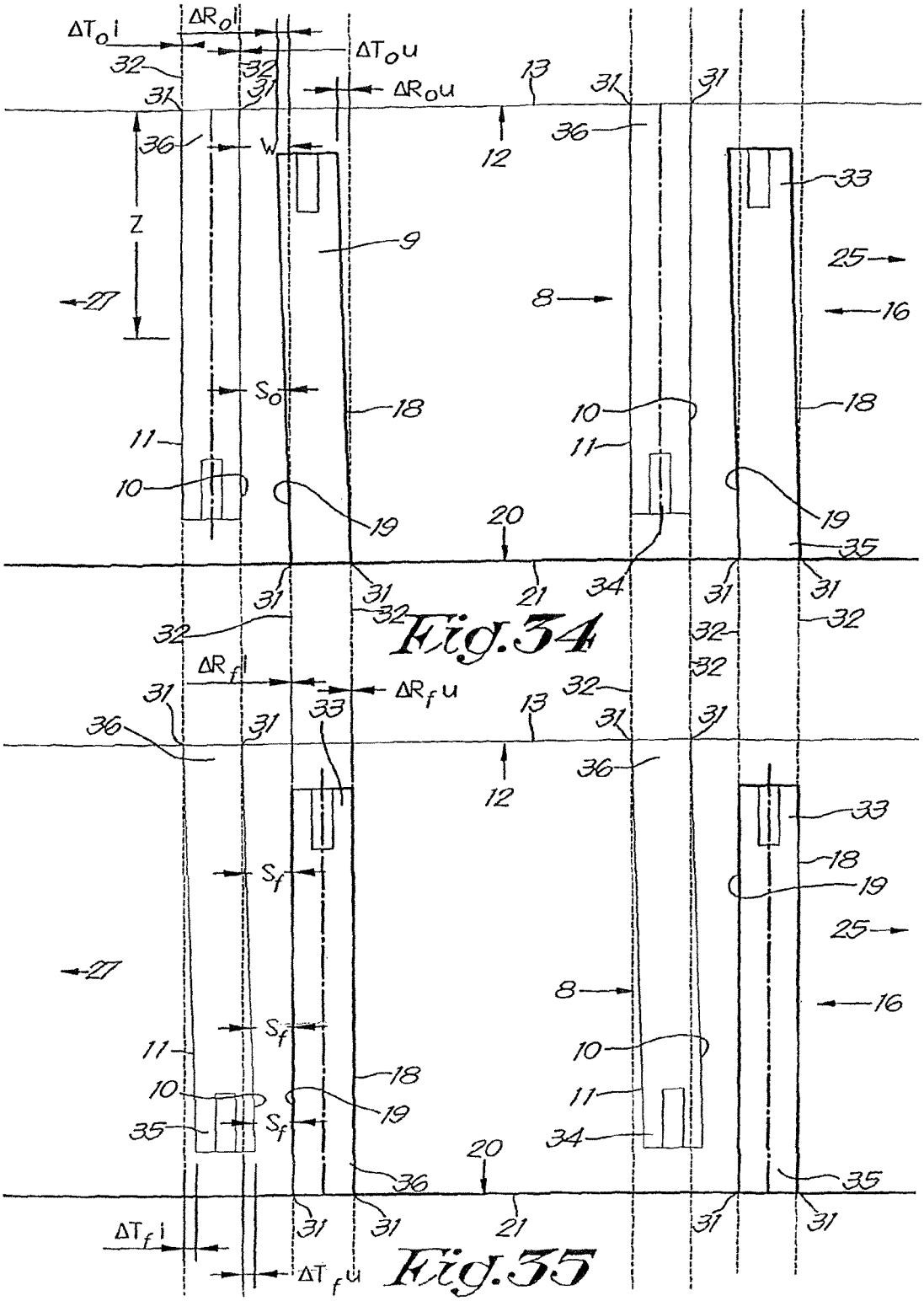

In the example of FIGS. 24 to 27 and of FIGS. 32 to 35, the stator scroll 8 is constructed with stator flanks 10 and 11 that are both perpendicular to the stator plate 13 when the scroll compressor 1 is stationary, while the rotor scroll 18 is constructed with rotor flanks 18 and 19 that both present a certain setback when the scroll compressor 1 is stationary in the case of FIGS. 24 to 27, more specifically they present a setback in a number of steps, or an inclination in the case of FIG. 32 or 35 with respect to the rotor plate 21, whereby the flanks 18 concerned and in their entirety form adapted flank sections 37 and 38.

As is shown by the drawings, similar effects can thus be obtained as in the previous embodiments with regard to making the profile of the instantaneous final local clearance S in certain instantaneous minimum openings 29 more even, and to reducing the instantaneous final clearance deviations $\Delta S_f$ at certain heights Z with respect to the stator plate 13 and in certain positions of the rotor 6 in the stator 7, whereby this time an adapted section of a rotor flank 18 or 19 always ensures the intended effect.

Preferably the adapted flank sections 37 and 38 in these embodiments which, when stationary, present a certain setback or inclination, will be perpendicular to the rotor plate 21 in nominal service.

It is not excluded in an analogous way to construct the rotor flanks 18 and 19 so that they are initially perpendicular to the rotor plate 21, while both stator flanks 10 and 11 of adapted flank sections 39 and 40 are designed to influence the instantaneous final clearance $S_f$ and instantaneous final clearance deviation $\Delta S_f$.

Other embodiments, whereby adapted flank sections of the scroll compressor 1 have a profile that is a combination of discontinuous and continuous sections with more or less curved forms or otherwise, are not excluded according to the invention.

The present invention is by no means limited to the embodiment of a scroll compressor 1 according to the invention, described as an example and illustrated in the drawings, but a scroll compressor 1 according to the invention can be realised in all kinds of forms and dimensions, without departing from the scope of the invention.

The invention claimed is:

1. A scroll compressor comprising a stationary stator scroll and a movable rotor scroll, each with a central axis, whereby said stator scroll and said rotor scroll are formed by a strip that is wound spirally along a length and which is affixed upright with a certain height on a stator plate or a rotor plate respectively, whereby each strip has two flanks, whereby intersecting lines of the flanks with the stator plate or the rotor plate concerned form spiral base edges, whereby a geometric location of points through which a perpendicular line on the stator plate intersects in an aforementioned spiral base edge determine ideal spiral flanks, whereby a radial distance between a point on the flank of the rotor scroll or the stator scroll and a closest ideal spiral flank defines a local flank deviation, respectively, a local stator flank deviation or a local rotor flank deviation, whereby the scroll compressor comprises a drive to move a rotor whereby a central axis of the rotor circles eccentrically around the central axis of the stator scroll without the rotor hereby undergoing a rotation around its central axis, whereby in each position of the rotor in a stator during this circling and eccentric movement of the rotor, places are formed to have either a maximum opening or a minimum opening between the rotor scroll and the stator scroll, whereby the places that have the maximum or the minimum opening are located in a facing plane; the facing plane comprises both aforementioned central axes, whereby in the places with the minimum opening at each local height with respect to the stator plate, the rotor flank and the stator flank concerned are located at a certain radial distance from one another, wherein the radial distances form local transverse internal clearances, whereby during a transition from an initial stationary state of the rotor to a final state in nominal service, pressures and temperatures in the scroll compressor change resulting in a deformation of the stator scroll and the rotor scroll and a change of the local stator flank deviations and the local rotor flank deviations, as well as the local transverse internal clearances, wherein at least one of the stator flanks or the rotor flanks comprises an adapted flank section whose form is initially adapted by having a local initial rotor flank deviation or a local initial stator deviation that is different to zero at each point of the adapted flank section concerned in the initial stationary state of the scroll compressor, whereby upon the transition of the scroll compressor from the initial stationary state to the final state in nominal service, the stator scroll and the rotor scroll deform such that during the movement of the rotor in nominal service there is an instantaneous final local stator flank deviation or an instantaneous final local rotor flank deviation at each point of the aforementioned adapted flank section concerned and in each position of the rotor, whose absolute value is less than the corresponding local initial stator flank deviation or the local initial rotor flank deviation at the same point when the rotor is stationary.

2. Scroll compressor according to claim 1, wherein at least one of the stator flanks or rotor flanks in its entirety forms an aforementioned adapted flank section.

3. Scroll compressor according to claim 1, wherein more than one of the stator flanks or rotor flanks in its entirety forms an aforementioned adapted flank section.

4. Scroll compressor according to claim 1, wherein the stator scroll and the rotor scroll are each provided with an aforementioned adapted flank section.

5. Scroll compressor according to claim 4, wherein the stator scroll and the rotor scroll have an inward stator flank or an inward rotor flank respectively that is turned towards the centre of the scroll compressor and an outward stator flank or an outward rotor flank respectively that is turned away from the centre of the scroll compressor and whereby the outward stator flank and the outward rotor flank are provided with the aforementioned adapted flank sections.

6. Scroll compressor according to claim 1, wherein for at least some of the positions occupied by the rotor during its movement, the local transverse internal clearances over the height of the stator flank concerned and rotor flank are constant during nominal service, so that these local transverse internal clearances over the height have a variation equal to zero in the positions concerned.

7. Scroll compressor according to claim 6, wherein for all positions occupied by the rotor during its movement, the local transverse internal clearances over the height of the stator flank and rotor flank concerned are constant during nominal service, so that the local transverse internal clearances over the height have a variation equal to zero in all positions occupied by the rotor.

8. Scroll compressor according to claim 1, wherein the stator scroll is profiled such that when the scroll compressor is stationary, an aforementioned adapted flank section of a stator flank presents a certain setback from the stator base formed by the edge of the stator strip at the stator plate up to the stator tip formed by a free edge of the stator strip or whereby this adapted flank section of the stator flank presents a certain inclination with respect to the stator plate, while an opposite flank section at the other flank of the stator scroll is made flat when stationary and is in a perpendicular position on the stator plate, so that the stator scroll has a thickness that is greater at the stator base than at the stator tip.

9. Scroll compressor according to claim 1, wherein the rotor scroll is profiled such that when the scroll compressor is stationary, an aforementioned adapted flank section of a rotor flank presents a certain setback from the rotor base formed by the edge of the rotor strip at the rotor plate up to the rotor tip formed by a free edge of the rotor strip, or whereby this adapted flank section of the rotor flank presents a certain inclination with respect to the rotor plate, while an opposite flank section at the other flank of the rotor scroll when stationary is made flat and is in a perpendicular position on the rotor plate, so that the rotor scroll has a thickness that is greater at the rotor base than at the rotor tip.

10. Scroll compressor according to claim 8, wherein the stator scroll and the rotor scroll have an inward stator flank or an inward rotor flank respectively that is turned towards the centre of the scroll compressor and an outward stator flank or an outward rotor flank respectively that is turned away from the centre of the scroll compressor, whereby the aforementioned adapted flank section of the stator flank with a setback or inclination forms part of the outward stator flank, and the aforementioned adapted section of the rotor flank with setback or inclination forms part of the outward rotor flank.

11. Scroll compressor according to claim 1, wherein the rotor scroll or the stator scroll is constructed with rotor flanks or stator flanks respectively that are both, when the scroll compressor is stationary, perpendicular on the rotor plate or the stator plate respectively.

12. Scroll compressor according to claim 1, wherein the rotor scroll or the stator scroll is constructed with rotor flanks or stator flanks respectively that, when the scroll compressor is stationary, both present a certain setback or inclination with respect to the rotor plate or the stator plate respectively, whereby the flanks concerned in their entirety form the aforementioned adapted flank sections.

13. Scroll compressor according to claim 1, wherein the adapted flank section of a stator flank or a rotor flank when stationary presents a certain setback or inclination, whereby this adapted flank section during nominal service is perpendicular to the stator plate concerned or the rotor plate concerned.

14. Scroll compressor according to claim 1, wherein the adapted flank section of a stator flank or a rotor flank presents a certain setback or inclination whereby the adapted flank section concerned has a continuous profile.

15. Scroll compressor according to claim 1, wherein the adapted flank section of a stator flank or a rotor flank presents a certain setback or inclination and the adapted flank section concerned has a discontinuous profile, whereby the thickness of the stator scroll or the thickness of the rotor scroll with the adapted flank section concerned decreases stepwise.

16. Scroll compressor according to claim 15, wherein in the adapted flank section of the stator flank or the rotor flank with a discontinuous profile, the thickness of the adapted flank section concerned of the stator scroll or the rotor scroll has one step change over its height.

17. Scroll compressor according to claim 15, wherein in the adapted flank section of the stator flank or the rotor flank with a discontinuous profile, the thickness of the adapted flank section concerned of the stator scroll or the rotor scroll has a number of step changes over its height.

18. Scroll compressor according to claim 1, wherein the scroll compressor is an oil-free scroll compressor.

19. Scroll compressor according to claim 2, wherein more than one of the stator flanks or rotor flanks in its entirety forms an aforementioned adapted flank section.

20. Scroll compressor according to claim 9, wherein the stator scroll and the rotor scroll have an inward stator flank or an inward rotor flank respectively that is turned towards the centre of the scroll compressor and an outward stator flank or an outward rotor flank respectively that is turned away from the centre of the scroll compressor, whereby the aforementioned adapted flank section of the stator flank with a setback or inclination forms part of the outward stator flank, and the aforementioned adapted section of the rotor flank with setback or inclination forms part of the outward rotor flank.

* * * * *